US007225503B1

(12) United States Patent
Lenkiewicz et al.

(10) Patent No.: US 7,225,503 B1
(45) Date of Patent: Jun. 5, 2007

(54) HAND-HELD DEEP CLEANER

(75) Inventors: Kenneth M. Lenkiewicz, Grand Rapids, MI (US); Alan J. Krebs, Pierson, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 544 days.

(21) Appl. No.: 10/707,212

(22) Filed: Nov. 26, 2003

Related U.S. Application Data

(60) Provisional application No. 60/319,738, filed on Nov. 27, 2002.

(51) Int. Cl.
*A47L 11/30* (2006.01)
*A47L 5/26* (2006.01)

(52) U.S. Cl. ..... 15/320; 15/344; 15/352; 15/353; 15/384; 15/390

(58) Field of Classification Search ..... 15/320, 15/344, 352, 353, 383, 384, 390, 321
See application file for complete search history.

(56) References Cited

U.S. PATENT DOCUMENTS

| | | | | |
|---|---|---|---|---|
| 4,317,253 | A | 3/1982 | Gut et al. | |
| 4,347,643 | A | 9/1982 | Bair, III | |
| 4,447,930 | A | 5/1984 | Glenn, III et al. | |
| 4,457,042 | A | 7/1984 | Jones et al. | |
| 4,776,058 | A | 10/1988 | Garner et al. | |
| 4,788,738 | A | 12/1988 | Monson et al. | |
| 4,798,613 | A | 1/1989 | Hetherington et al. | |
| 4,930,178 | A | 6/1990 | Monson et al. | |
| 5,341,541 | A | 8/1994 | Sham | |
| 5,367,740 | A | 11/1994 | McCray | |
| 5,477,578 | A * | 12/1995 | Duncan et al. | 15/320 |
| 5,507,068 | A | 4/1996 | Fan et al. | |
| 5,590,439 | A | 1/1997 | Alazet | |
| 5,599,401 | A | 2/1997 | Brosky et al. | |
| 5,655,254 | A * | 8/1997 | Bores et al. | 15/320 |
| 5,784,755 | A * | 7/1998 | Karr et al. | 15/321 |
| 5,867,864 | A | 2/1999 | Miller et al. | |
| 5,970,572 | A | 10/1999 | Thomas | |
| 6,031,969 | A | 2/2000 | Burr et al. | |
| 6,125,498 | A | 10/2000 | Roberts et al. | |
| 6,145,159 | A | 11/2000 | Zahuranec et al. | |
| 6,154,917 | A | 12/2000 | Zahuranec et al. | |
| 6,347,428 | B1 | 2/2002 | Shimko et al. | |
| D456,102 | S | 4/2002 | Murphy et al. | |
| D456,963 | S | 5/2002 | Murphy et al. | |
| 6,397,429 | B1 * | 6/2002 | Legatt et al. | 15/320 |
| 6,425,958 | B1 * | 7/2002 | Giddings et al. | 15/321 |
| 6,550,098 | B2 * | 4/2003 | Roberts et al. | 15/320 |
| 6,609,269 | B2 * | 8/2003 | Kasper | 15/320 |
| 6,859,976 | B2 * | 3/2005 | Plankenhorn | 15/380 |
| 6,968,593 | B1 * | 11/2005 | Lenkiewicz et al. | 15/320 |
| 2002/0133890 | A1 | 9/2002 | Hannan et al. | |

* cited by examiner

*Primary Examiner*—Theresa T. Snider
(74) *Attorney, Agent, or Firm*—McGarry Bair PC

(57) ABSTRACT

A liquid extraction cleaner includes a solution dispensing system, a liquid recovery system, and an agitation brush assembly. The solution dispensing system includes a supply tank removably affixed to a housing and fluidly connected to a fluid distributor through a trigger-operated manual spray pump. The liquid recovery system includes a recovery tank removably mounted to the housing adjacent to the supply tank. An air liquid separator is provided within the recovery tank. Another assembly within the housing provides a vacuum source, where working air comes from the recovery tank to an inlet between a motor and an impeller. The agitation brush assembly is removably mounted in a lower forward portion of the housing.

25 Claims, 22 Drawing Sheets

HAND-HELD DEEP CLEANER

CROSS REFERENCE TO RELATED APPLICATIONS

This application claims the benefit of U.S. Provisional Application Ser. No. 60/319,738 filed Nov. 27, 2002.

BACKGROUND OF INVENTION

1. Field of the Invention

This invention relates generally to extraction cleaners and more particularly to a portable hand-held deep cleaner that applies cleaning fluid to a surface, agitates the surface, and then extracts the applied fluid therefrom.

2. Description of the Related Art

Portable hand-held extraction cleaners having a cleaning solution supply tank and a recovery tank are known. These extraction cleaners typically have a vacuum motor that powers an impeller to create low pressure on one side of the impeller and higher pressure on the other side thereof. The recovery tank is typically positioned between the low-pressure side of the impeller and a fluid collection nozzle to remove fluid from a surface and deposit it in the recovery tank. It is also known to provide a separate cleaning fluid pump for directing cleaning fluid from the supply tank to the surface.

One hand-held deep cleaning device is disclosed in U.S. Pat. No. 4,788,738 issued to Monson et al. on Dec. 6, 1988. In this arrangement, a hand-held deep cleaner has a handle section removably joined to a lower discharge section. A collection chamber receives fluid from a surface through a nozzle opening that communicates with the intake side of a vacuum motor. The collection tank houses a hollow plenum chamber and a centrifugal separator attached to a vacuum blower. A cleaning fluid tank is pressurized by exhaust air from the outlet side of the rotating vacuum blower to force cleaning fluid under pressure from the cleaning fluid tank to a supply nozzle when a solution supply trigger is depressed to thereby apply cleaning fluid to a surface.

U.S. Pat. No. 5,367,740 issued to McCray on Nov. 29, 1994, discloses a hand-held deep cleaner that includes a housing, a handle, a body portion, and a nozzle with a suction opening. A collection tank is removably supported on the housing and is fluidly connected to a vacuum pump. The vacuum pump has an exhaust port and is powered by an electric pump motor. A solution tank is removably connected to the housing and is pressurized by a pressure pump that is also connected to the pump motor. A separate drive motor is coupled to a rotatable brush for scrubbing a surface to be cleaned.

U.S. Pat. No. 6,125,498 to Roberts et al. discloses a hand-held liquid extraction cleaner including a recovery tank mounted to the forward end of a cleaner housing with a suction nozzle and conduit on a front face of the recovery tank connected to an inlet opening in the recovery tank. A vacuum source is connected to the recovery tank through an exhaust conduit, integrally formed in the recovery tank, for drawing liquid and debris through the suction nozzle and the suction conduit and into the recovery tank. A removable cleaning fluid supply tank is mounted to a rear portion of the cleaner housing, an adjustable fluid distributor is mounted to the suction conduit and a pump is positioned in a supply conduit between the fluid distributor and the cleaning fluid supply tank for supplying pressurized cleaning fluid from the cleaning fluid supply tank to the fluid distributor. The pump includes an impeller which is positioned in an outlet opening of a reservoir in which the cleaning fluid is deposited from the cleaning fluid supply tank.

U.S. Pat. No. 4,776,058 to Garner et al. discloses a portable vacuum surface cleaning apparatus that includes an integrated suction nozzle and recovery tank removably mounted to a forward portion of a housing and a rotatably driven brush mounted to a rear portion of the housing. A cleaning solution tank at a rear portion of the housing has a discharge flow passage directed rearwardly adjacent the brush. An electrical vacuum source is mounted in the housing.

U.S. Pat. No. 5,507,068 to Fan et al. discloses a hand-held fluid extractor having a suction nozzle at a front portion thereof, a fluid delivery tank mounted beneath the suction nozzle and a fluid recovery tank mounted beneath the solution tank. A plenum chamber 68 is connected to the suction conduit 82 and separates the air from the recovered liquid which drops from the plenum chamber 68 into the recovery tank 28. The fluid delivery tank and the fluid recovery tank are removable from the suction nozzle.

A commercially available form of the portable vacuum surface cleaning apparatus disclosed in the Garner et al. '058 patent was manufactured and sold by Ryobi Motor Products under the trademark 1344 SPOT COP. The Ryobi SPOT COP extractor did not have a rotary-driven brush agitator and included a fluid dispenser adjacent to the suction nozzle at a front portion of the recovery tank. The cleaning solution was delivered to the fluid distributor from a cleaning solution tank at a rear portion of the housing through a pump.

The Shimko et al. U.S. Pat. No. 6,347,428 discloses a hand-held extractor with a hand pump adjacent to the handle to pump cleaning solution to a fluid distributor adjacent to the suction nozzle. In addition, a rotary brush is mounted to a main housing behind the suction nozzle and is driven about a vertical axis by a turbine motor which is connected to the suction source for the extractor. A valve alternately connects the suction source to the turbine motor and to the suction nozzle.

SUMMARY OF INVENTION

According to the invention, a liquid extraction cleaner of the type that includes a dirty fluid extraction system and a cleaning fluid dispensing system has a housing has a rearwardly extending pocket at the rear portion of a housing, a recovery tank removably received at least partially within the pocket. Typically, an air-liquid separator is positioned within the recovery tank.

In a preferred embodiment, the housing has an integral handle between the front and rear portions thereof for carrying and operating the cleaner.

In a further embodiment, the cleaning fluid supply tank and the recovery tank have interengaging releasable fasteners to removably mount the cleaning fluid supply tank to the recovery tank. The recovery tank preferably includes an inlet duct and an outlet duct. The recovery tank further includes a sealable opening that is closed with a cap to seal the opening, the cap has an outward protrusion to facilitate removal of the cap from the opening and the cap protrusion matingly aligns with a recess in the housing when the recovery tank is properly seated within the housing pocket.

In another preferred embodiment, the cleaning solution supply tank and the housing have interengaging releasable fasteners that removably mount the cleaning solution supply tank to the housing. Preferably, the recovery tank includes at least one flange and the cleaning solution supply tank has a channel that slidably receives the flange for removably mounting the cleaning solution supply tank to the recovery tank. In a specific embodiment, the at least one flange is on a top portion of the recovery tank and the cleaning solution supply tank channel is on a lower portion of the cleaning solution supply tank for removably mounting the cleaning solution tank to the recovery tank. Thus, the recovery tank can be removed from the housing with or without the cleaning solution supply tank attached thereto. Alternatively, the cleaning solution supply tank can be removed from the recovery tank with the recovery tank mounted to the housing.

In another embodiment, in a forward portion of the housing a cartridge is removably mounted to the housing, the removable cartridge further comprises at least one rotating agitation brush that is driven by a drive motor and wherein the rotation direction of the at least one brush is determined by the orientation of the cartridge in the housing. In a preferred embodiment, two brushes are rotatably mounted in the cartridge. In one embodiment, the two brushes are mounted to rotate in the same direction. In another embodiment, the two brushes are mounted to rotate in different directions. In yet another embodiment, the orientation of the cartridge in the housing determines the rotational speed of the brush or brushes.

In still another embodiment, a clutch mechanism is mounted between the brush and the drive motor to disconnect the drive from the brush when the brush resistance exceeds a predetermined torque. In a preferred embodiment, the clutch has a plurality of resilient fingers connected to one of the drive and the brush and that extend generally radially and a ring mounted on the other of the drive and the brush and with a plurality of indentations that the receive the resilient fingers.

In yet another embodiment of the invention, the vacuum source further comprises a fan chamber defined in part by the housing. Further, the vacuum source includes an impeller that creates a working air flow and a motor for driving the impeller; and the impeller has an inlet opening between the motor and the impeller. Thus, the working air generated by the vacuum source is delivered to the impeller from an inlet between the motor and the impeller. Further, the impeller has an outlet opening that is positions distal to the motor. In addition, an exhaust conduit having a vent opening is formed in part by the housing.

DETAILED DESCRIPTION

Figure 1:
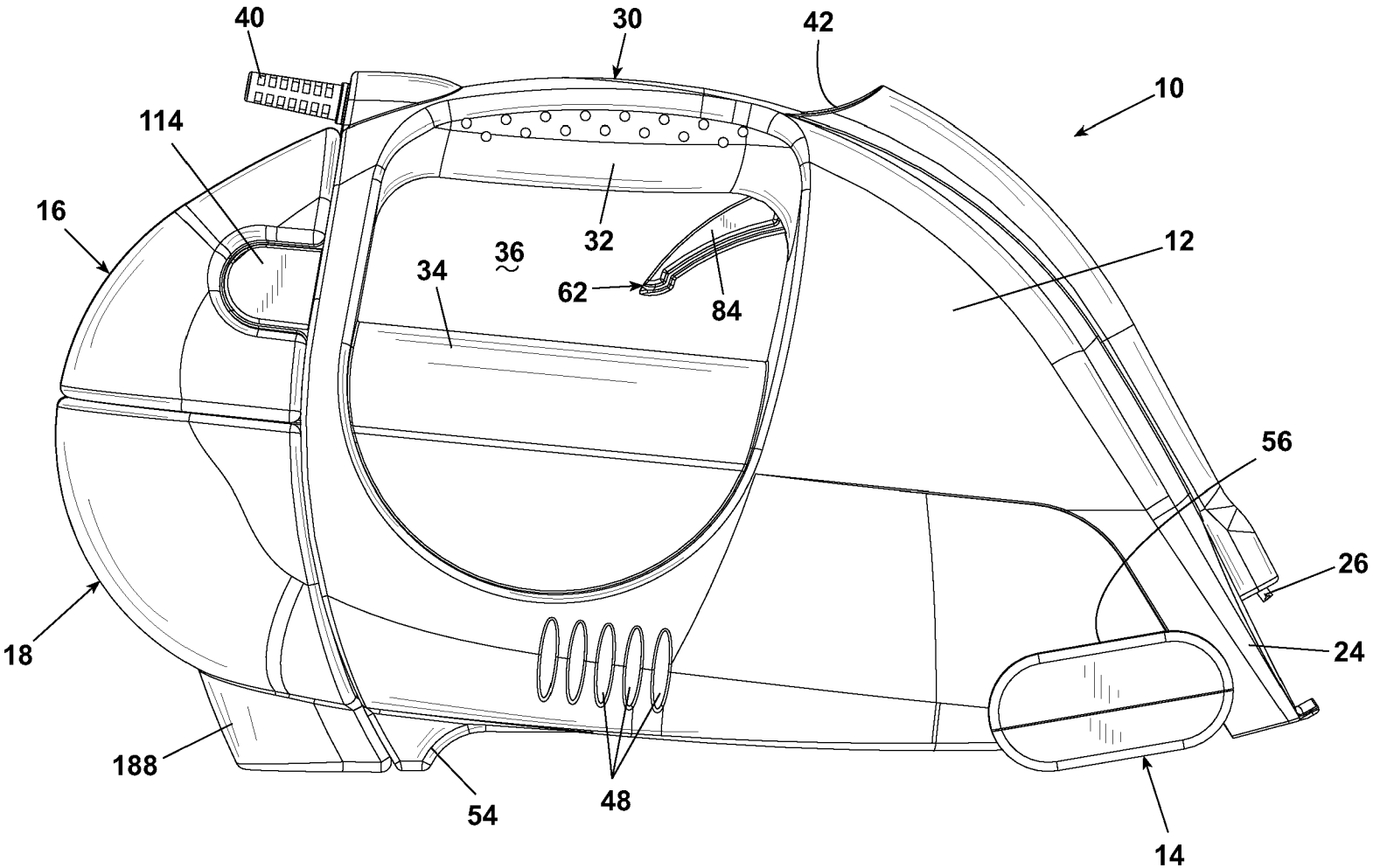
FIG. 1 is a side elevational view of a portable hand-held deep cleaner according to the invention.
Figure 2:
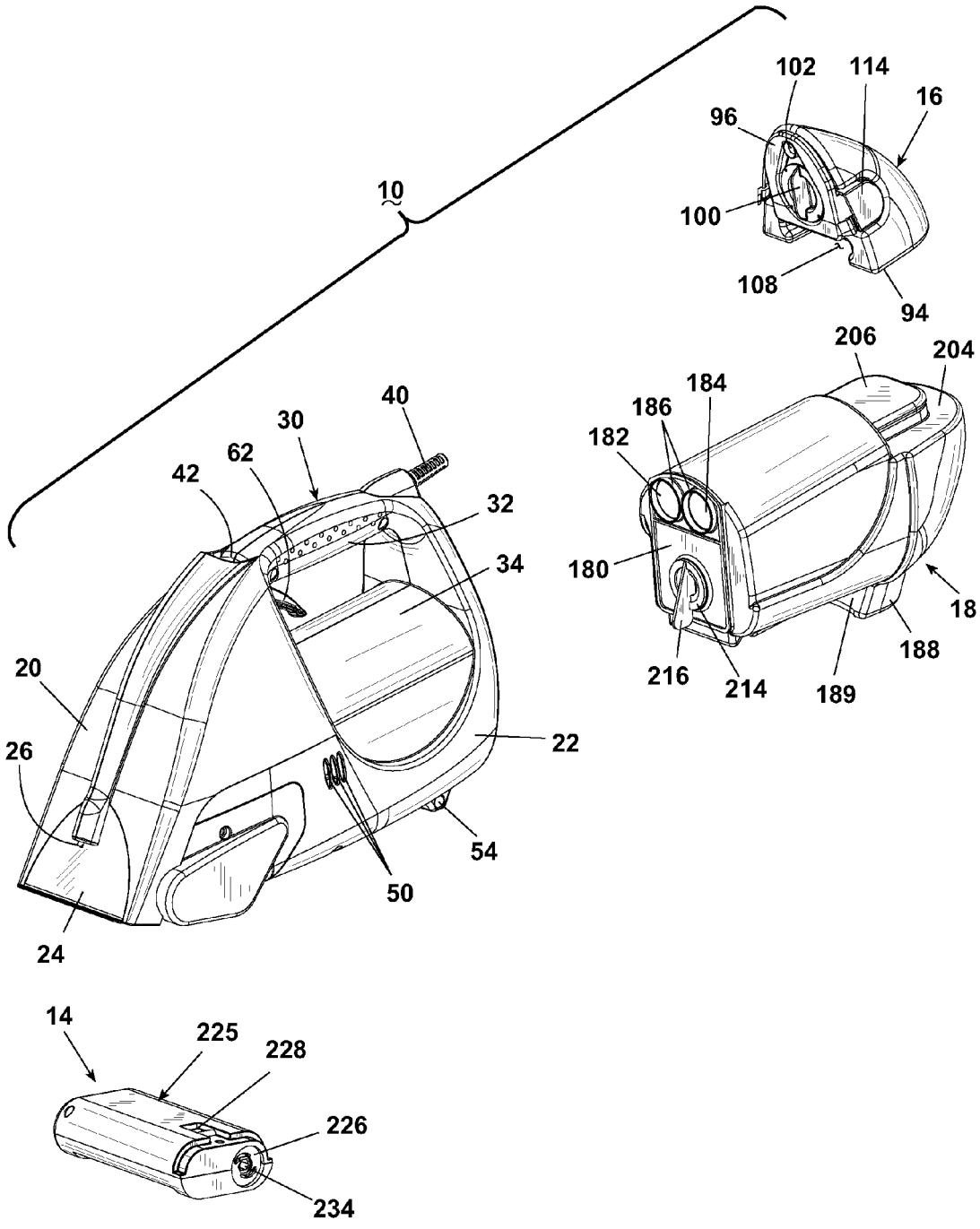
FIG. 2 is an exploded perspective view of the portable hand held deep cleaner of FIG. 1.
Figure 3:
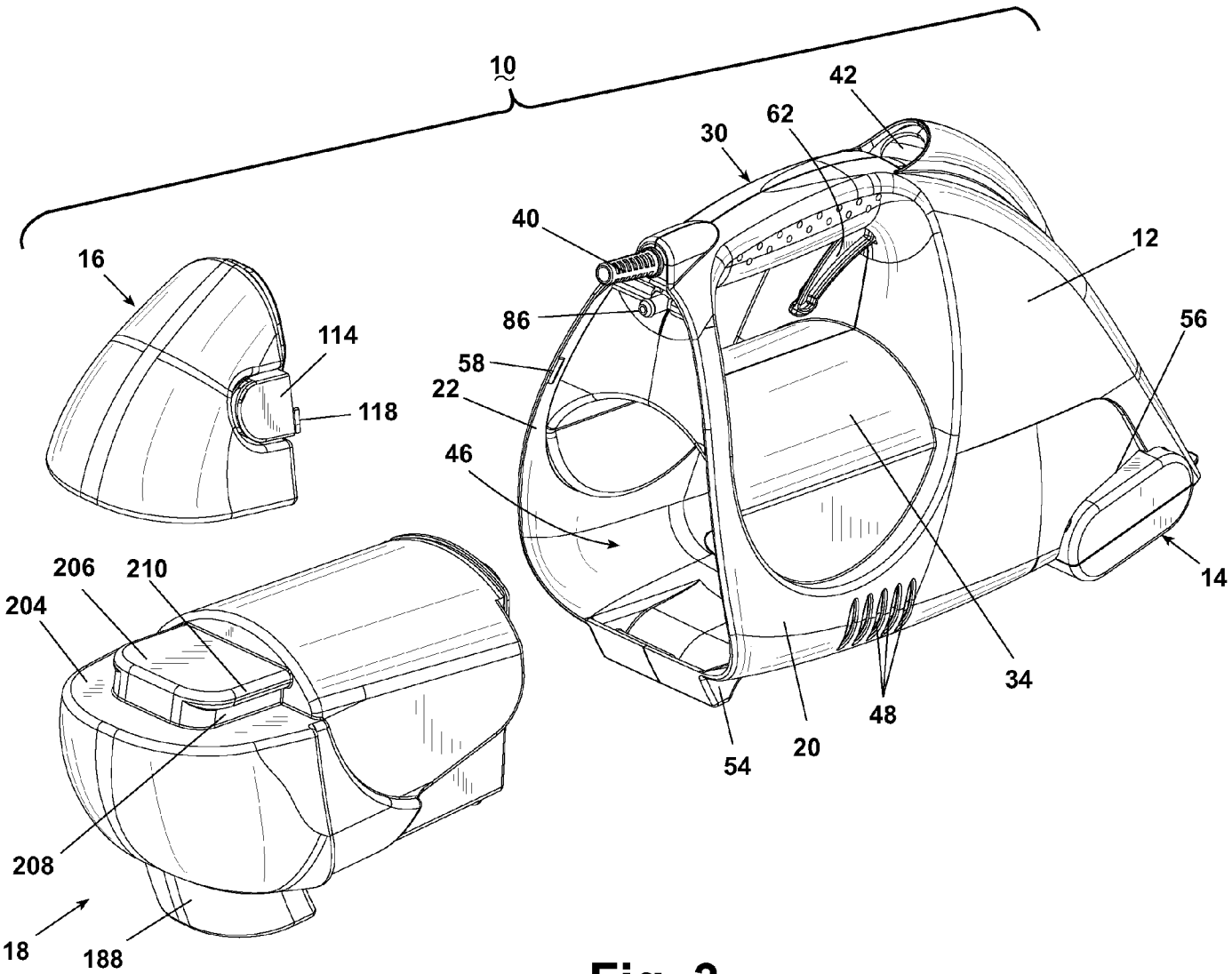
FIG. 3 is an exploded perspective rear view of the portable hand held deep cleaner of FIGS. 1 and 2.

Referring now to FIGS. 1–3, a portable hand-held deep cleaner 10 comprises a housing 12, a cleaning fluid distribution system, a dirty fluid extraction system, and a removable rotatable agitator brush assembly 14. The cleaning fluid distribution system includes a removable cleaning fluid supply tank 16, and the dirty fluid extraction system includes a removable recovery tank 18. In the following description, references to "forward", "rearward", "upper", "lower" and related terms indicate orientation relative to the right, left, top, and bottom, respectively, of the hand held deep cleaner 10 in FIG. 1.

Figure 8:
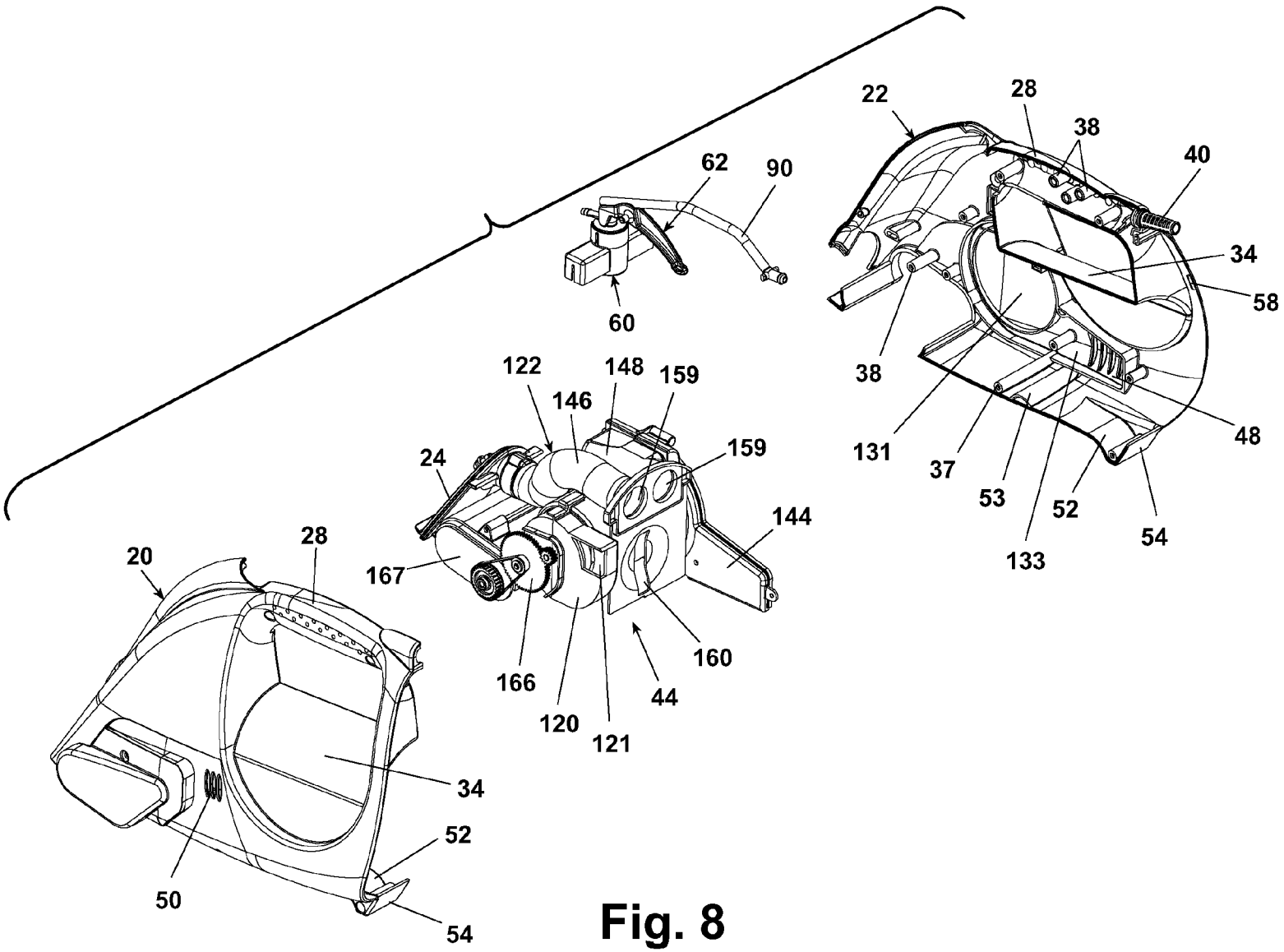
FIG. 8 is an exploded perspective rear view of the housing and interior components of FIG. 5.
Figure 9:
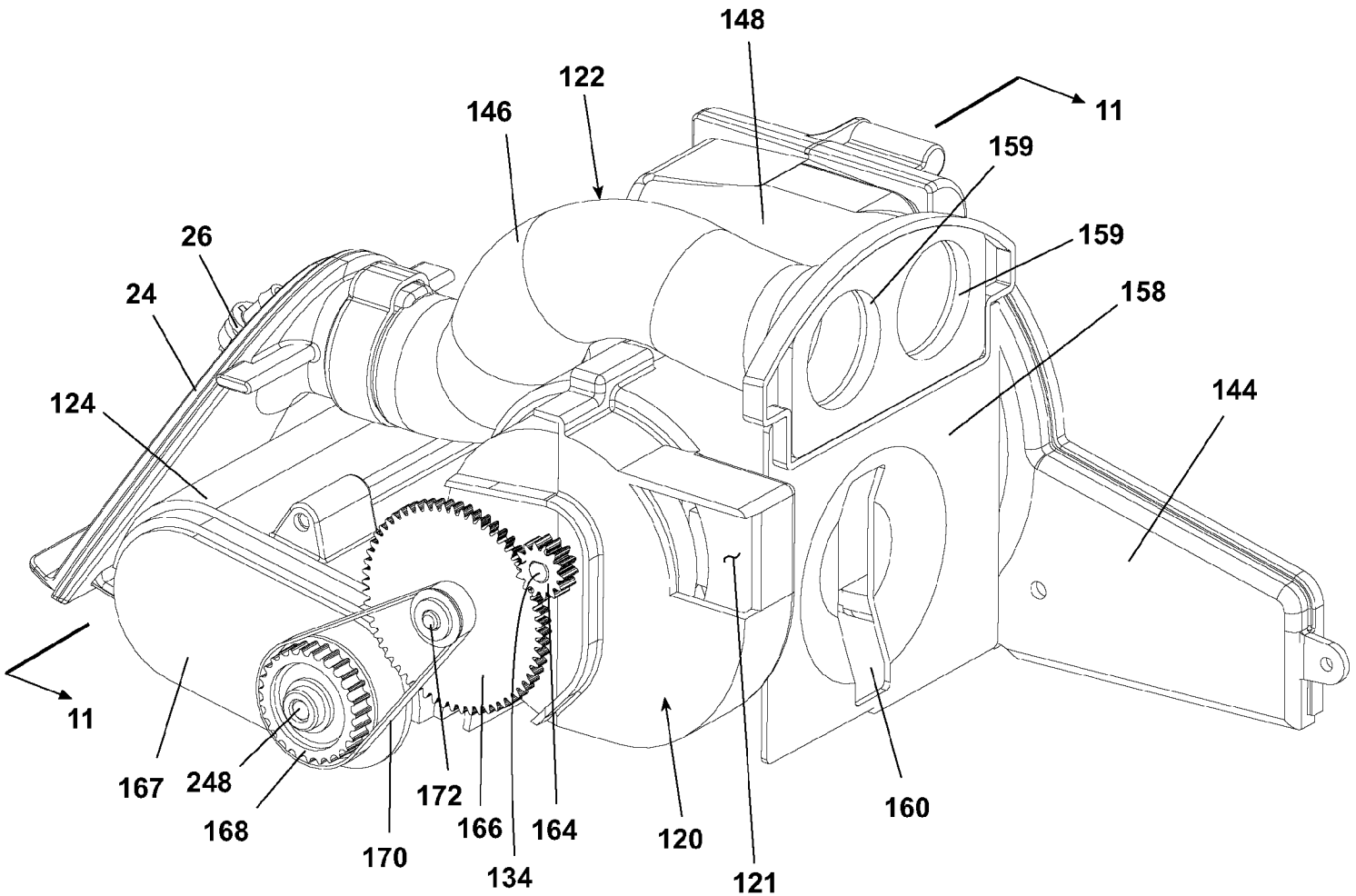
FIG. 9 is a close up rear perspective view of the vacuum source and brush drive assembly of the portable hand-held deep cleaner according to the invention shown in FIG. 8.

Looking now also at FIG. 8, the housing 12 is formed by a first shell half 20 and a second shell half 22 that, when mounted together, houses in its interior elements of the cleaning fluid distribution system and the dirty fluid recovery system. The exterior of the housing 12 mounts a suction nozzle 24 at a forward end thereof and a fluid distributor 26 adjacent the suction nozzle 24. It will be understood that the fluid distributor can have any configuration, including that disclosed in U.S. Pat. No. 6,125,498, the disclosure of which is incorporated herein by reference. Each shell half also includes an integrally molded handle portion 28 that, when assembled together, form a unitary handle 30 having a grip lower surface 32 on the underside of the handle. The lower surface 32 of the handle 30 and an upper wall 34 together partially define a cavity 36 to accommodate a hand opening for hand carrying of the extractor.

Each shell half 20, 22 includes a plurality of bosses 38 that are in alignment with corresponding bosses in the other shell half. The shell halves 20, 22 are preferably fastened together by installing threaded fasteners in the bosses in a well-known manner. A cord (not shown) is adapted to connect to a power source (not shown) and extends rearwardly from the handle 30 through a strain relief 40. It will be understood that the cord can be adapted to accommodate any standard voltage and plug configuration, regardless of geographic location, including, for example, 120 volts at 60 Hz or 220 volts at 50 Hz. A switch 42 is mounted to the housing at the front of the handle 30 for convenient operation by a user's thumb. The switch 42 is electrically connected to the cord 40 (and thus to the power source) and to a vacuum and brush drive assembly 44 to selectively actuate the dirty fluid extraction system, and the removable rotatable agitator brush assembly 14.

A pocket 46 is formed in rear of the housing 12 beneath the upper wall 34 and sized to receive the recovery tank 18. A plurality of elongate exhaust apertures 48 extend through the first shell half 20 to permit exhaust air to escape from the interior of the housing 12 when the dirty fluid extraction system is operating. A plurality of vent apertures 50 are also provided in the second shell half 22 to vent any heat generated by the vacuum and brush drive assembly 44 during operation of the removable rotatable agitator brush assembly 14.

A lower wall 52 of the housing 12 includes a foot portion 54 that helps maintain the hand-held deep cleaner 10 in a substantially horizontal upright position when not in use and also provides an abutment for the recovery tank 18. The lower wall 52 also has an upstanding dimple 53 forward of the foot portion 54. A recess 56 at a forward portion of the housing 12 behind the suction nozzle 24 accommodates the removable rotatable agitator brush assembly 14. Also, a pair of detents 58 is located at the upper rear of the housing 12.

Figure 7:
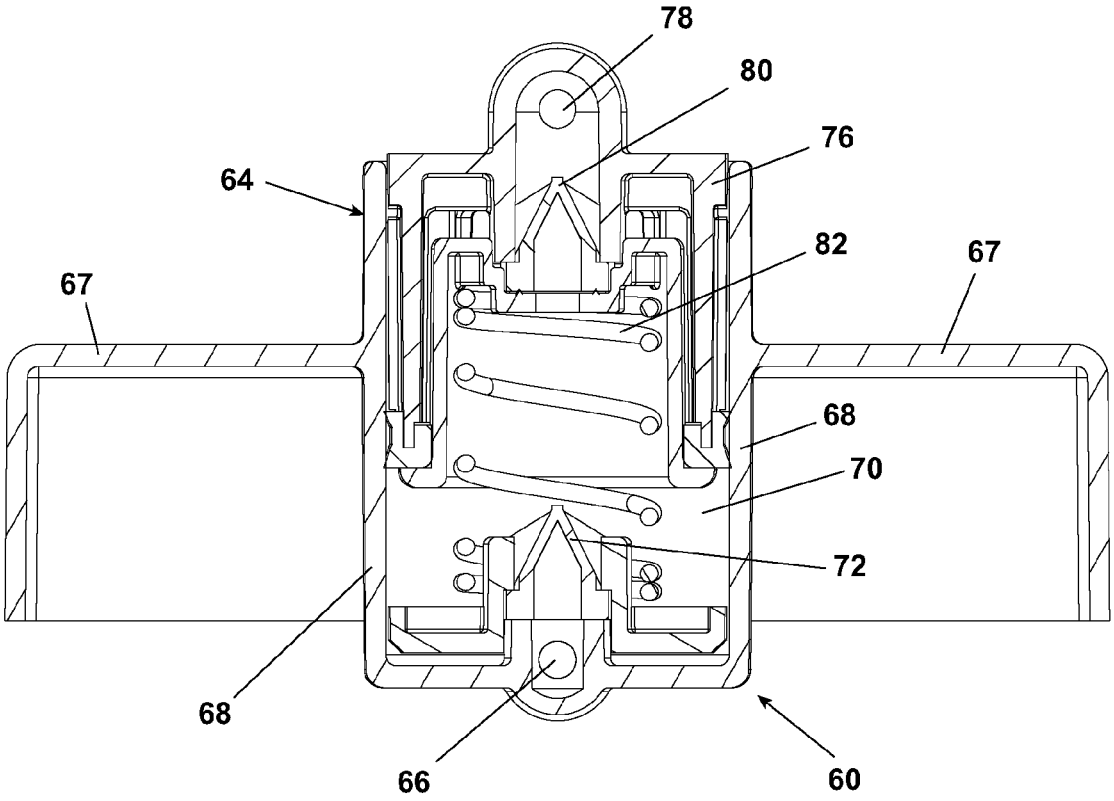
FIG. 7 is a cross sectional view of the manual pump assembly taken along lines 7—7 of FIG. 6.

Looking now at FIGS. 4–7, the fluid distribution system includes the removable cleaning fluid supply tank 16, a manual pump assembly 60, a trigger 62, a plurality of solution supply conduits, and the fluid distributor 26. The manual pump assembly 60 is secured to the interior of the housing 12 through shoulders 67 that are received in sockets 63 on the inside of the shell halves 20, 22. In FIG. 7, the manual pump assembly 60 has a housing 64 with an inlet 66 at a lower portion of a cylinder 68 defining a chamber 70. A first duckbill check valve 72 is between the inlet 66 and the chamber 70. A piston 76 in the cylinder 68 has an outlet 78 at an upper portion open to the chamber and a second duckbill check valve 80 is on the piston 76 between the outlet 78 and the chamber 70. A spring 82 in the cylinder 68 between the housing 64 and the piston 76 biases the piston upwardly. The trigger 62 rotates about a pivot 83 mounted to the handle 30 and has a lever 84 on one side of the pivot 83 extending into the cavity 36 (see FIG. 1) and an actuator 85 on the other side of the pivot 83 bearing against the piston 76.

Figure 4:
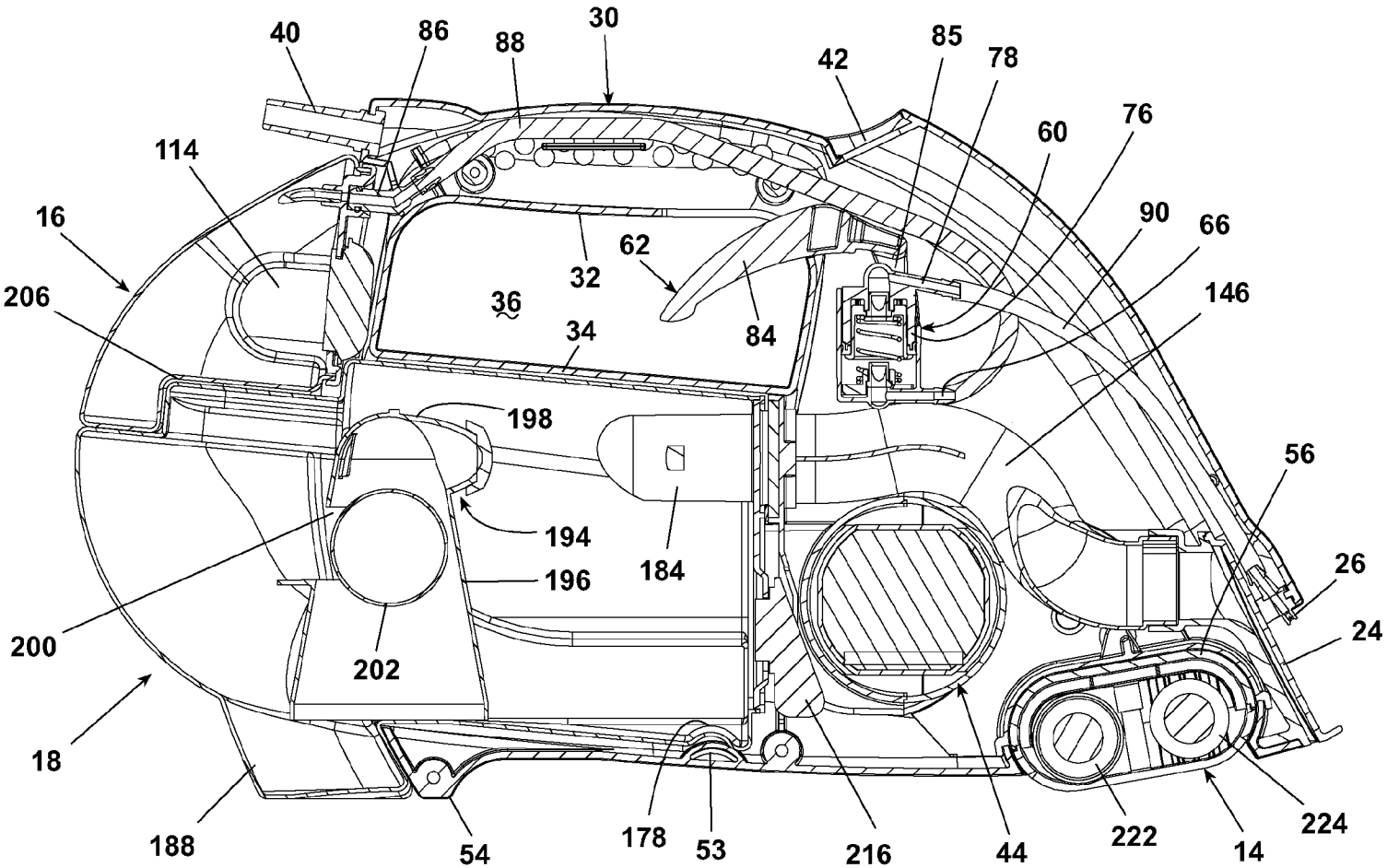
FIG. 4 is a cross sectional side view of the portable hand held deep cleaner of FIGS. 1–3.
Figure 5:
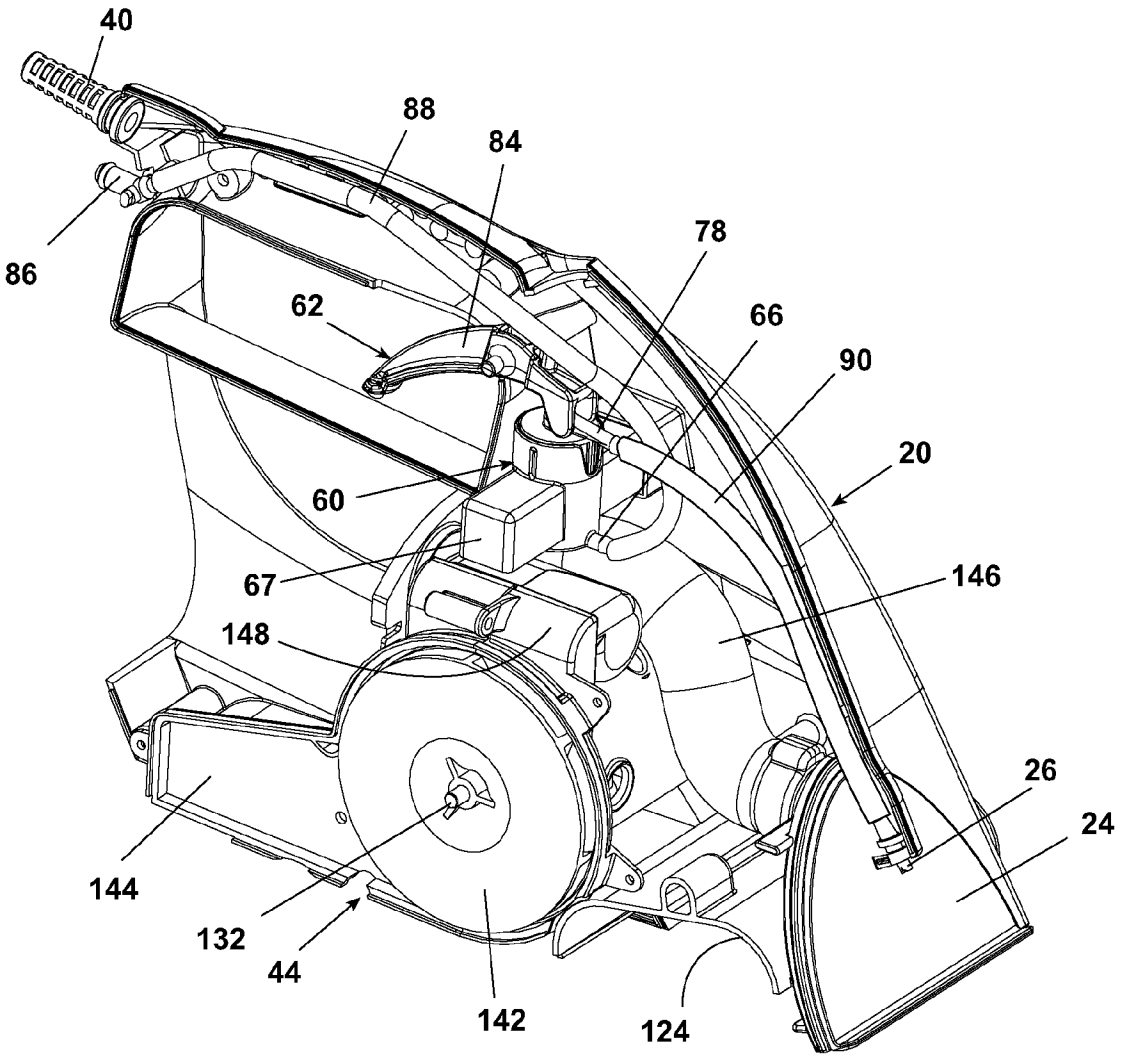
FIG. 5 is a perspective view of the housing of a portable hand-held deep cleaner according to the invention with parts broken away to show interior components.
Figure 6:
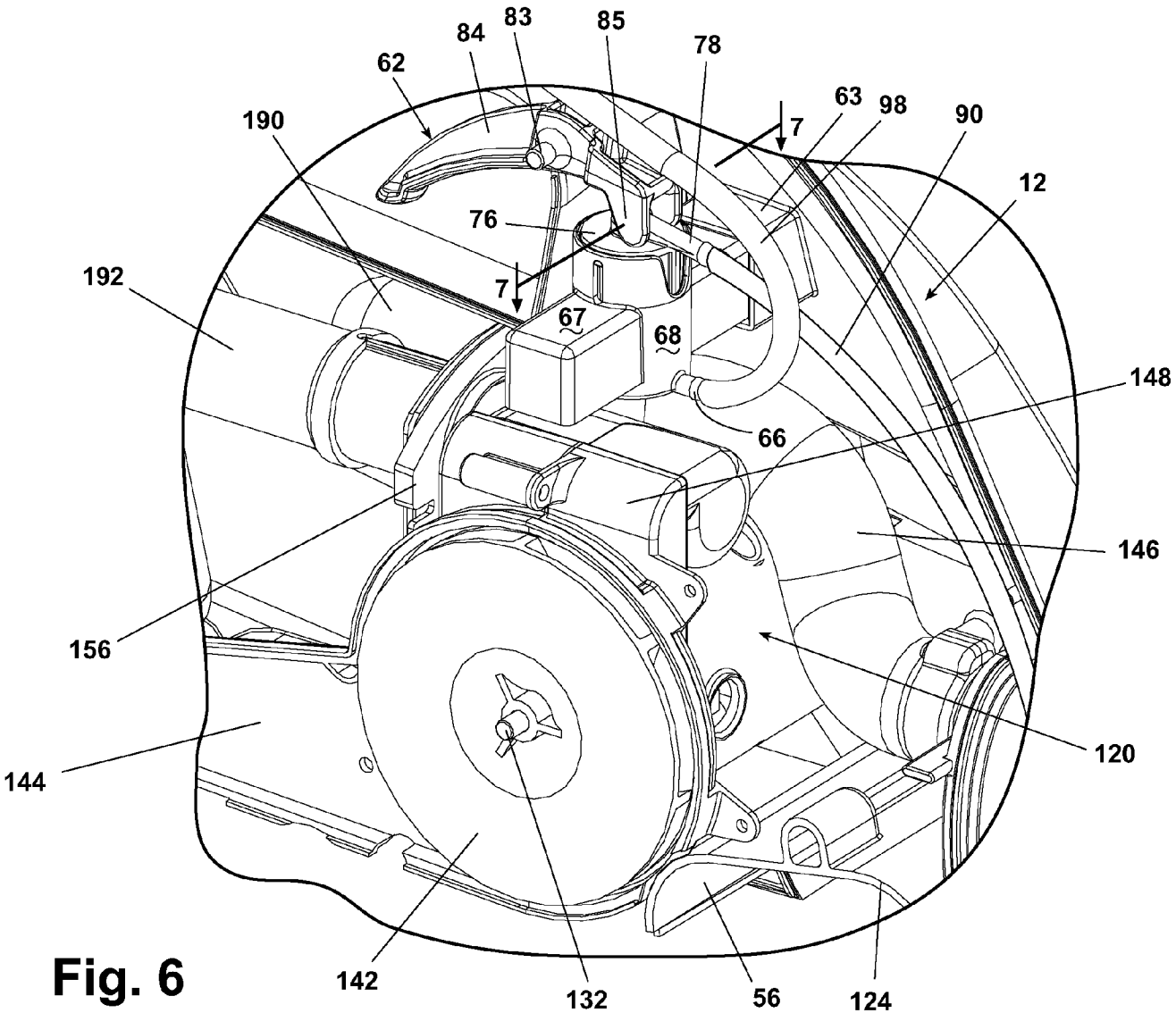
FIG. 6 is a close up view of a portion of the vacuum source and manual pump assembly within the housing shown in FIG. 5.

Referring more particularly to FIGS. 4 and 7, a male fitting 86 is mounted to the rear of the housing 12 and adapted to fluidly connect to the removable cleaning fluid supply tank 16 when the removable cleaning fluid supply tank is mounted to the housing 12 in a manner to be described later. A first delivery conduit 88 extends from the male fitting 86 forwardly where it connects to the inlet 66 on the manual pump assembly 60. A second delivery conduit 90 extends from the outlet 78 on the manual pump assembly 60 to the fluid distributor 26. Squeezing the lever 84 of the trigger 62 toward the handle 30 urges the actuator 85 to depress the piston 76 against the spring 82 and shrinks the chamber 70, increasing pressure and forcing any fluid therein out of the second duckbill check valve 80 to the outlet 78 and thence to the fluid distributor 26. Releasing the lever 84 enables the spring 82 to urge piston 76 upwardly, creating negative pressure in the chamber 70, sucking fluid from the inlet 66 (which is fluidly connected to the cleaning fluid supply tank 16) through the first duckbill check valve 72 into the chamber 70.

Figure 12:
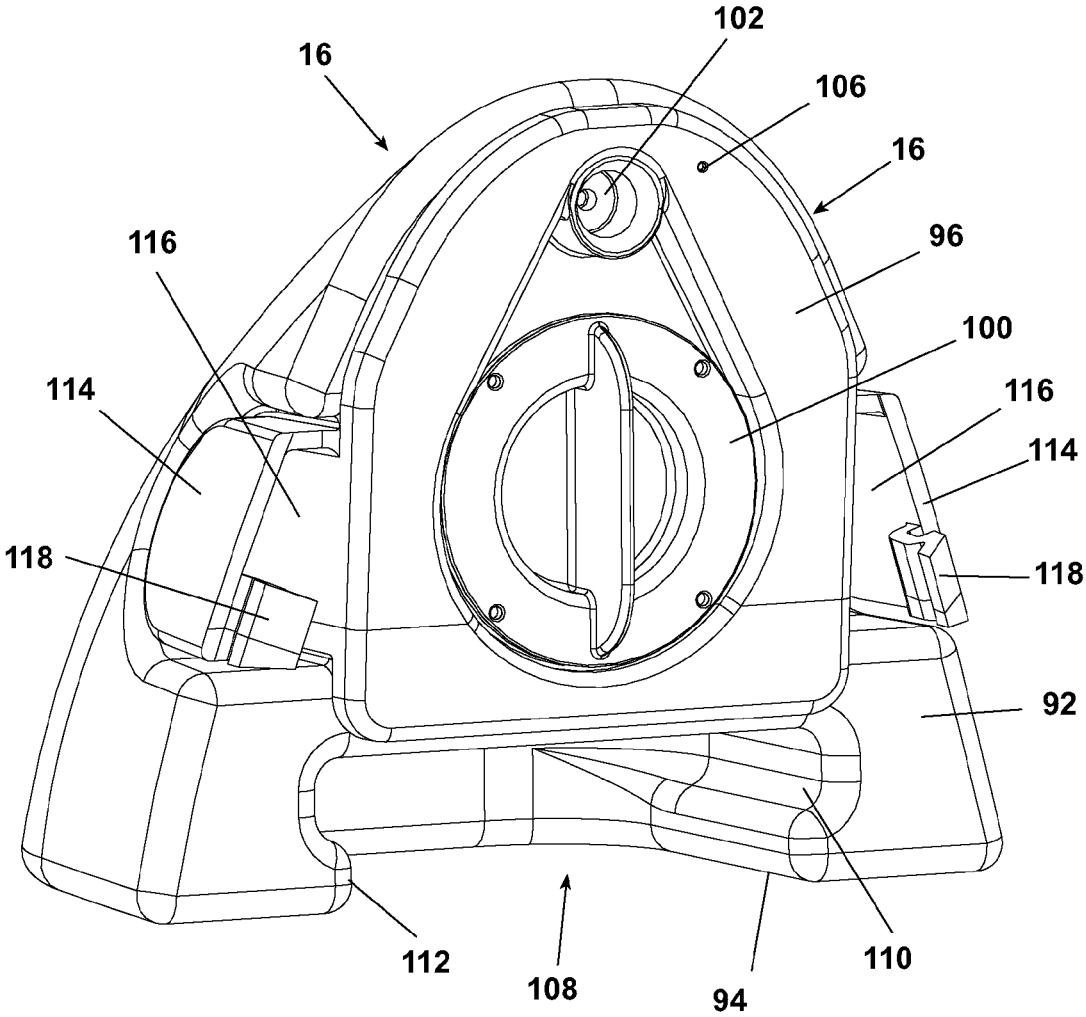
FIG. 12 is a perspective view of the cleaning fluid supply tank according to the invention.
Figure 13:
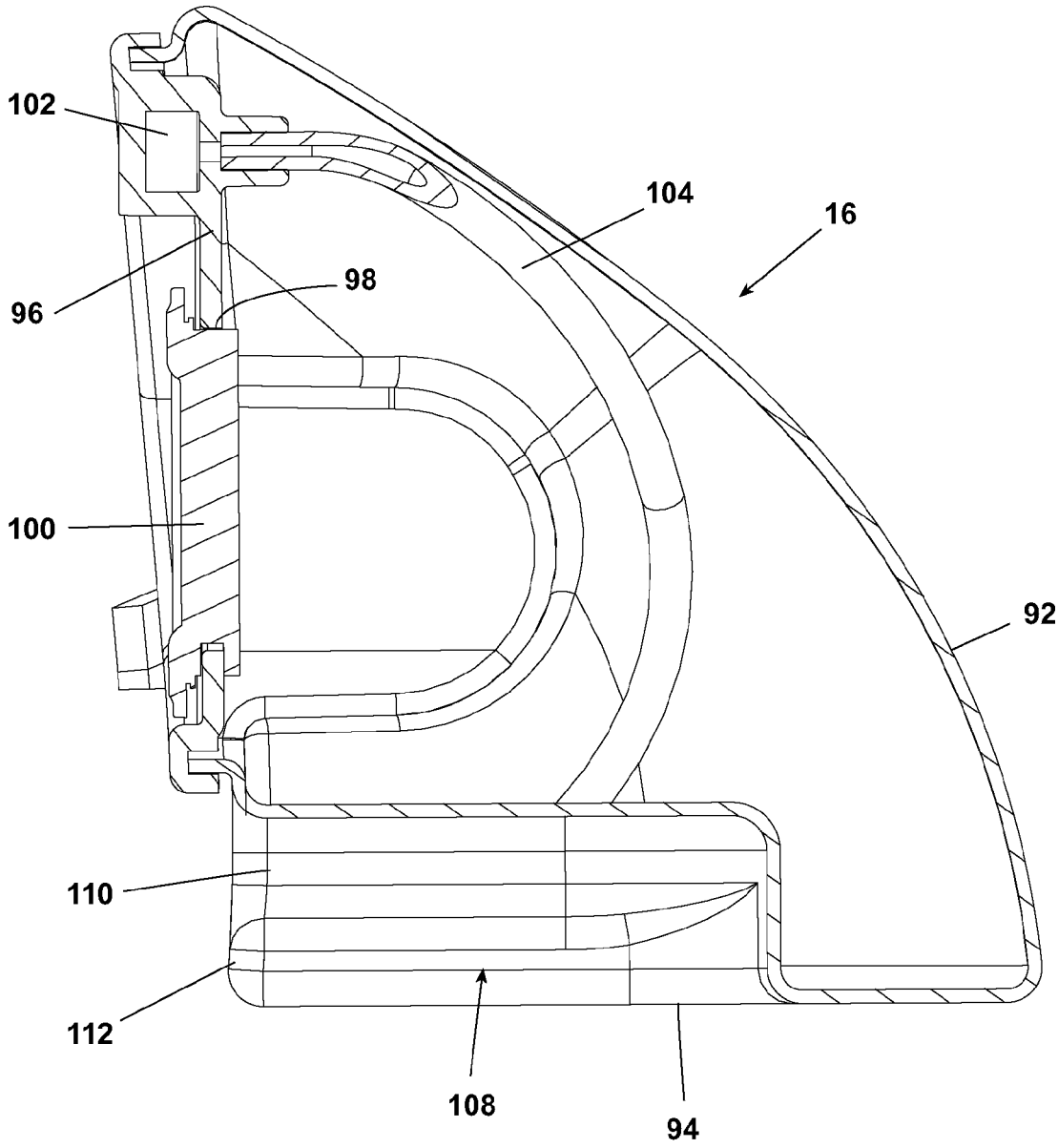
FIG. 13 is a cross sectional view of the cleaning fluid supply tank of FIG. 12.

As shown also in FIGS. 12 and 13, the cleaning fluid supply tank 16 is adapted to be removably mounted in a rearward portion of the housing 12. The cleaning fluid supply tank 16 comprises a hollow tank body 92, having a lower wall 94, and a face wall 96. The tank body 92, including the lower wall 94, is preferably molded with the face wall 96 being attached thereto. The face wall 96 has an opening 98 in which a plug 100 is removably sealed. Above the opening 98 and plug 100 is a female fitting 102 adapted to connect to the male fitting 86 and thereby fluidly connect the cleaning fluid supply tank 16 to the remainder of the fluid distribution system. A pick up tube 104 extends into the tank to the lower wall 94 from the female fitting 102. A vent hole 106 is provided in the face wall 96 at an upper portion thereof. The vent hole 106 serves to prevent a vacuum from forming in the cleaning fluid supply tank 16 as manual pump assembly 60 draws solution from the tank.

A slot 108 is formed in the lower wall 94 comprising a U-shaped channel 110 with a flange 112 at a lower portion thereof. Latches 114 on both sides of the cleaning fluid supply tank 16 are hingedly mounted to the tank body 92 in recesses 116 therein, and are biased outwardly. Each latch 114 has a tab 118 extending forwardly therefrom, sized and positioned to engage the detent 58 on each side of the housing 12.

Figure 10:
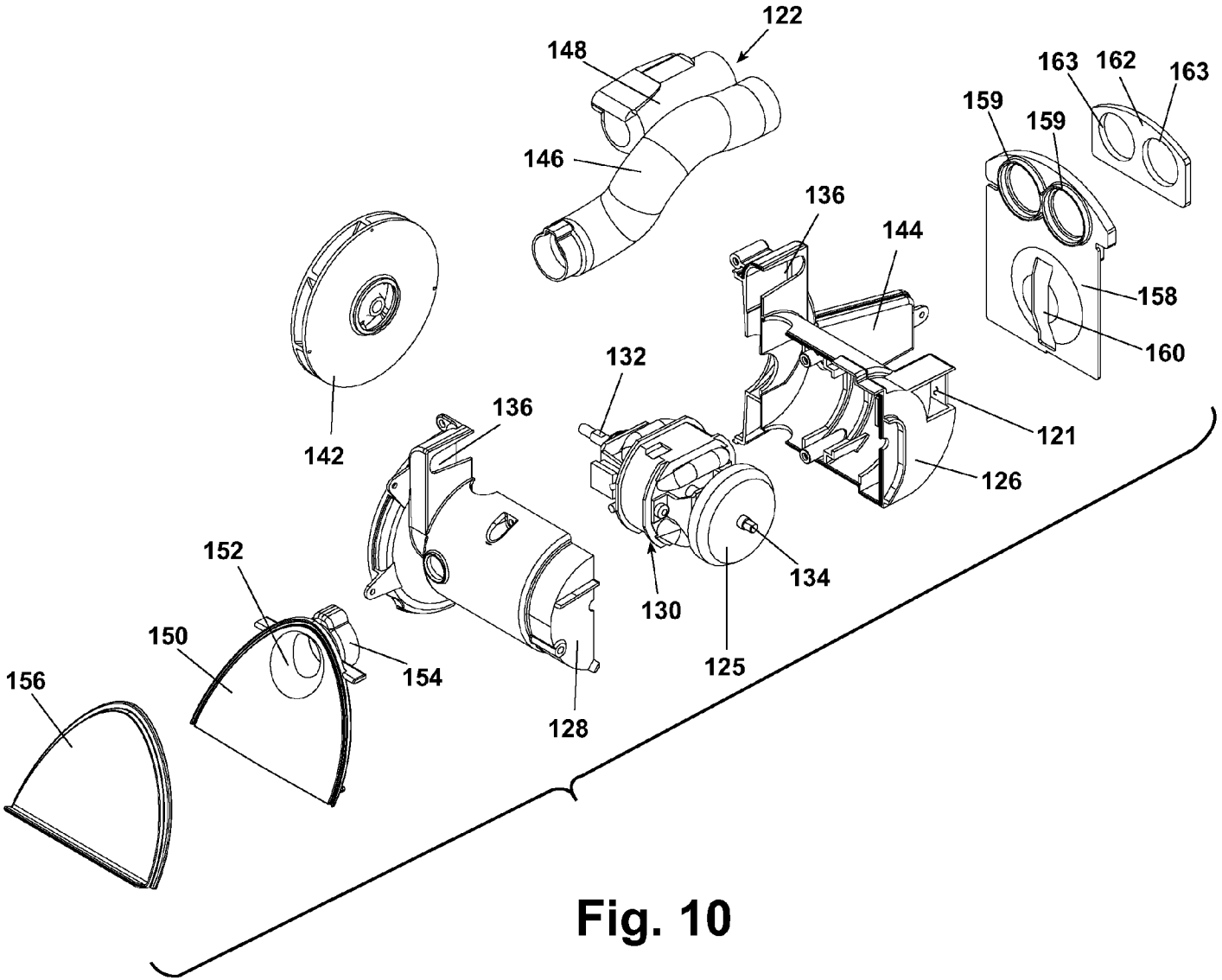
FIG. 10 is an exploded perspective view of the vacuum source of FIGS. 1 and 9.

Referring now to FIGS. 6 and 8–11, the vacuum and brush drive assembly 44 comprises a motor cooling fan housing 120 that has an outlet 121 that sealing mates with the exhaust apertures 50. Above the motor cooling fan housing 120 is an air manifold 122. A brush assembly receptacle 124 is positioned in front of the air manifold 122. A motor cooling fan 125 is attached to a brush drive shaft 134 and is driven by the motor 130 to draw cooling air through inlet apertures 129 to cool the motor. In FIG. 10, it will be seen that the motor housing 120 comprises two shell halves 126, 128 that enclose a motor 130. Second shell half 22 further comprises a circular indentation 131 that forms an outer fan chamber. An elongated indentation 133 is formed in the second shell half 22 and is connected to the circular indentation 131 to form a portion of an exhaust conduit. The motor 130 has an impeller drive shaft 132 extending from one side and a brush drive shaft 134 extending from the other side. Looking specifically at FIG. 11, the housing shell halves 126, 128 combine to form an impeller inlet manifold 136 on the side of the impeller drive shaft 132 positioned between the motor 130 and an impeller 142, having an inlet port 138 and an outlet port 140. The impeller 142 is fixedly mounted to the impeller drive shaft 132 outboard of the impeller inlet manifold 136. An impeller housing 144 (see FIG. 8) sealingly mates with the fan chamber 131 and directs air from the impeller rearwardly toward the exhaust apertures 48 in the housing 12.

Figure 11:
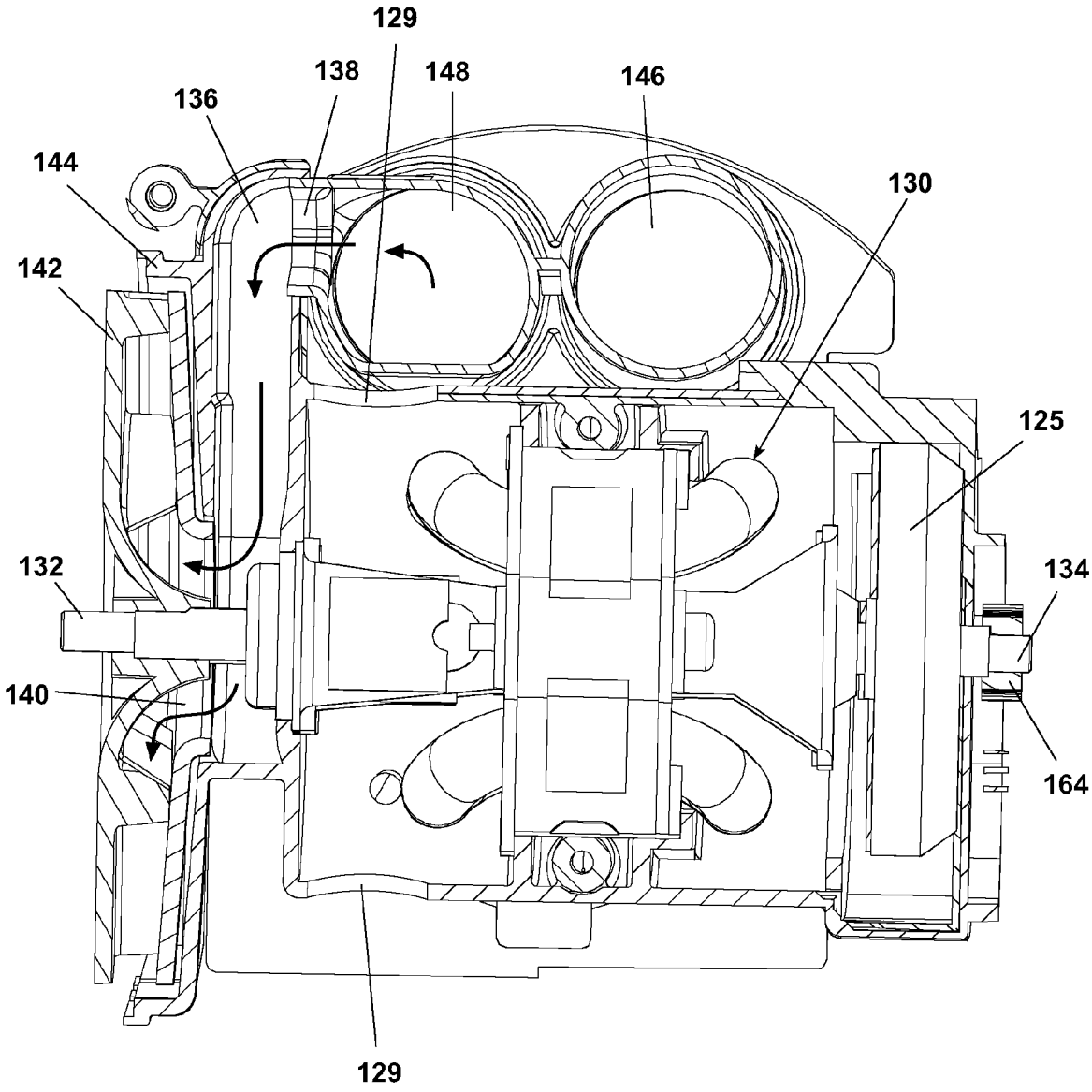
FIG. 11 is a cross sectional view of the vacuum source taken along lines 11—11 of FIG. 9.

Referring to FIG. 11, working air flow is shown by arrows. Working air is drawn from the working air conduit 148 through the inlet port 138 and into the inlet manifold 136. Working air is then drawn into an inlet of the impeller 142 away from the motor 130, exhausted through the outlet port 140 and ultimately exits the housing 22 through exhaust apertures 48.

The air manifold 122 above the motor housing 120 has a suction conduit 146 and a working air conduit 148 sideby-side. The forward end of the suction conduit 146 fluidly connects to the suction nozzle 24. The suction nozzle 24 comprises a rear plate 150 having an aperture 152 and a fitting 154 around the aperture 152 extending rearwardly therefrom. The rear plate 150 is covered by a face plate 156 which is flush with the front of the housing 12. In a preferred embodiment, the rear plate 150 and the face plate 154 are made of a transparent material to facilitate visibility of the brush assembly 14 and the suction of materials through the suction nozzle 24. The fitting 154 connects to the forward end of the suction conduit 146. The rearward end of the suction conduit 146 terminates at a manifold plate 158 behind the motor housing 120. The manifold plate 158 has a pair of openings 159 at an upper portion in communication with the suction conduit 146 and the working air conduit 148. The forward end of the working air conduit 148 fluidly connects to the inlet port 138 of the impeller inlet manifold 136. The rearward end of the working air conduit 148 terminates at the manifold plate 158 next to the suction conduit 146. The manifold plate 158 has a vertical slot 160 at a central portion thereof. A gasket 162 having openings 163 surrounds the terminating ends of the suction conduit 146 and the working air conduit 148 rearwardly of the manifold plate 158.

The brush assembly receptacle 124 is disposed between the motor housing 120 and the suction nozzle 24 within the recess 56. Looking more specifically at FIG. 9, a first gear 164 fixedly mounted to the brush drive shaft 134 meshes with a reduction gear 166 rotatably mounted to the motor housing 120. An end cap 167 on the brush assembly receptacle 124 carries a drive gear 168 through a drive shaft, which is driven by a belt 170 extending around the drive gear 168 and a shaft 172 on the reduction gear 166. The motor is electrically connected to the switch 42 on the housing 12 and is energized by actuating the switch when the cord 40 is connected to a power source. Looking at FIG. 11, it can be seen that the air path from the working air conduit 148 to the impeller 142 (shown by arrows) is through the inlet port 138, into the impeller inlet manifold 136, then through the outlet port 140 into the impeller 142. This air path extends between the motor 130 and the impeller 142.

Figure 14:
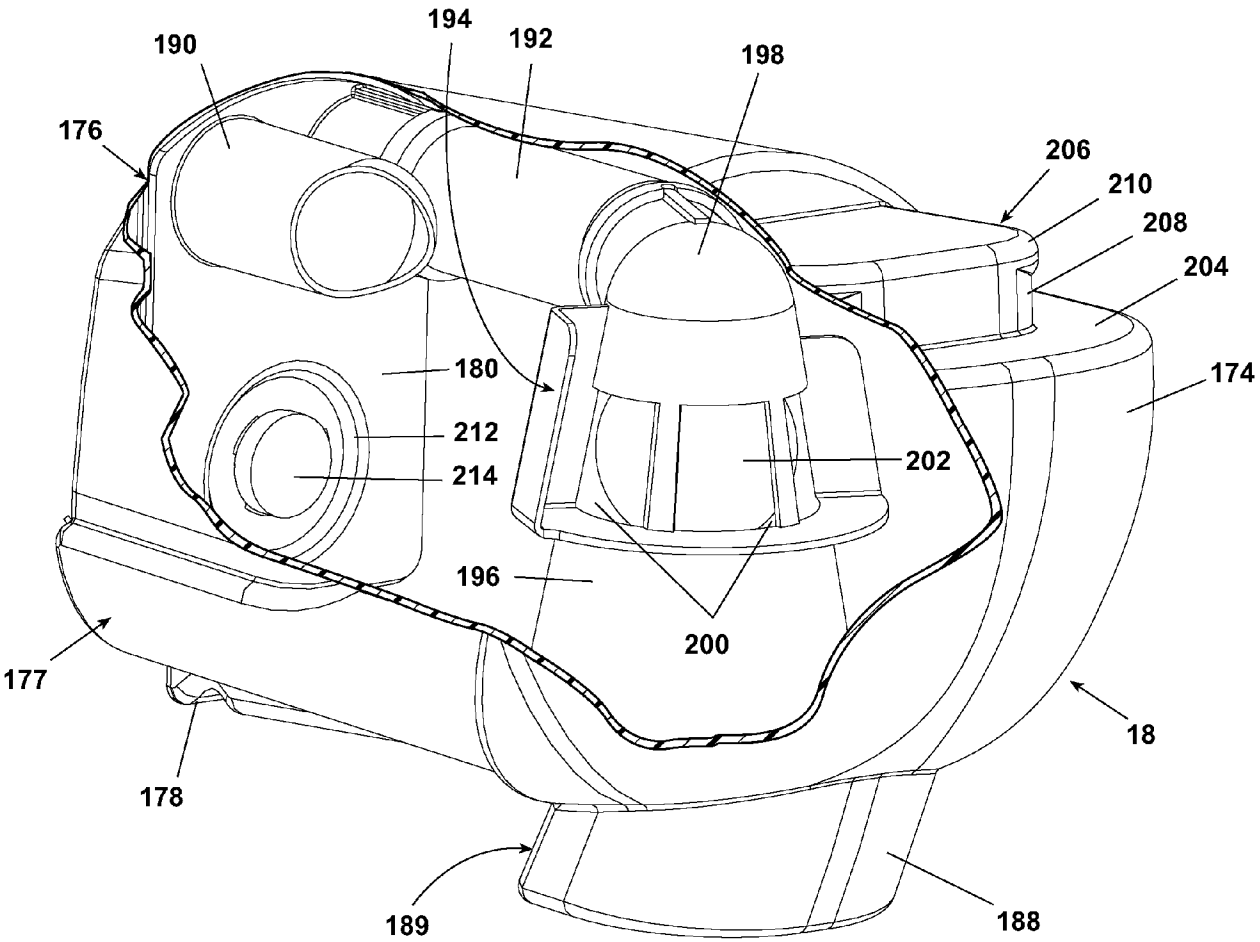
FIG. 14 is a perspective view of the recovery tank according to the invention with parts broken away to show interior components.

Referring now also to FIGS. 4 and 14, the dirty fluid recovery system includes the suction nozzle 24, the suction conduit 146, the working air conduit 148, the impeller 142 and the recovery tank 18. The recovery tank 18 comprises a tank body 174, preferably molded, having an opening 176 at a forward end. The forward portion 177 of the tank body 174 is shaped and sized complementary to the pocket 46 of the housing 12 to be received snugly therein. A slight recess 178 in a lower portion of the tank body 174 toward the forward end is sized and shaped to receive the dimple 53 on the lower wall 52 of the housing 12 and helps retain the recovery tank within the pocket. A front plate 180 covers the opening 176 to completely enclose the recovery tank 18. An upper portion of the front plate 180 (see FIG. 2) has a working air opening 182 and a suction opening 184 disposed to be in registry with the rearward ends of the working air conduit 148 and suction air conduit 146, respectively, when the recovery tank 18 is received within the pocket 46. Preferably, the front plate 180 will snuggly abut the manifold plate 158 when the recovery tank 18 is received within the pocket 46. In order to secure a leak free connection, fittings 186 around the openings 182, 184 may be provided that will engage the gasket 162. A heel 188 is provided at the rear of the recovery tank to help maintain the hand-held deep cleaner 10 in a substantially horizontal upright position when not in use. The heel has an abutment surface 189 sized and shaped to complement the foot portion 54 of the housing 12.

Within the recovery tank (see FIG. 14), a suction tube 190 extends from the suction opening 184 and terminates in space at an upper portion of the interior. A working air tube 192 extends from the working air opening 182 to an air liquid separator 194. The air liquid separator 194 comprises an inverted cone-shaped body 196 having an open wide end facing the lower portion of the tank interior. The wide end of the body 196 may rest on the bottom of the recovery tank 18. The upper end 198 of the cone body 196 is in fluid communication with the working air tube 192. Near its intersection with the working air tube 192 are a plurality of openings 200. A float ball 202 inside the cone shaped body 196 is sized to block airflow through the working air tube 192. The float ball 202 is free to move within the cone 192, and moves toward the top of the cone as liquid level in the recovery tank 18 rises.

At the rearward end of the tank body 174 on an upper surface thereof, there is a planar area 204. Extending above the planar area 204 is a raised portion 206 having a channel 208 surrounding it and a flange 210 at the upper portion thereof. The raised portion 206 is thus sized and shaped to be received within the slot 108 of the cleaning fluid supply tank 16. The tank interior is accessed by way of an access opening 212 in the front plate 180, which is closed by a cover 214 that can be selectively removed by a tab 216. Typically, rotating the tab 216 will enable the cover 214 to be removed so that dirty fluid in the recovery tank can be disposed of. The location of the cover 214 and tab 216 is such that the tab will be received in the vertical slot 160 on the manifold plate 158 when the recovery tank is received in the pocket 46, thus assuring that the cover 214 is properly sealed on the recovery tank 18 as the tank is received in the pocket. If the cover 214 is not properly sealed, the tab 216 will be out of position and bar proper seating of the tank 18 in the pocket 46.

Assembling the cleaning fluid supply and recovery tanks 16, 18 to the housing 12 may be accomplished with the recovery tank inserted into the pocket 46 first, until the recess 178 nests on the dimple 53, with the front plate 180 abutting the manifold plate 158 and the tab 216 received within the vertical slot 160. The cleaning fluid supply tank 16 can then be placed with the raised portion 206 of the recovery tank 18 nesting within the slot 108 on the underside of the tank body 92. The channel 110 on the cleaning fluid supply tank 18 receives the flange 210 of the recovery tank, and the channel 208 of the recovery tank receives the flange 112 of the cleaning fluid supply tank. Simultaneously, the tabs 118 are received in the detents 58 to secure the cleaning fluid supply tank to the housing 12 and the female fitting 102 receives the male fitting 86 to establish fluid communication between the cleaning fluid supply tank and the rest of the fluid distribution system. Thus, the recovery tank 18 is secured within the pocket 46 of the housing 12, the cleaning tank 16 is secured to the housing 12, and both tanks 16, 18 are secured to each other. Alternatively, the solution tank 16 may be assembled to the recovery tank 18 and then both the recovery tank 18 and supply tank 16 may be inserted as a unit into the pocket 46.

It will be apparent that air will not flow from the suction conduit 146 to the working air conduit 148 without the recovery tank 18 in place. When the motor 130 is energized, the impeller 142 urges air to flow out of the exhaust apertures 48, drawing air from the impeller inlet manifold 136, which in turn draws air from the working air conduit and the working air tube within the recovery tank 18. Because the interior of the recovery tank is sealed, negative pressure within the recovery tank draws a vacuum in the suction tube 190 and the suction conduit 146, also drawing a vacuum in the suction nozzle 24, where liquid and debris can be sucked in. Within the recovery tank 18, liquid and debris are deposited at the bottom of the tank while air is drawing into the working air tube 192 and thence to the impeller 142. As the liquid level in the recovery tank 18 rises, the float ball 202 rises within the cone body 196 until it is high enough to block air flow entering the working air tube 192. At this point, airflow effectively stops, limiting suction and undoubtedly changing the sound emanating from the cleaner so that the user knows the recovery tank is full.

Figure 15:
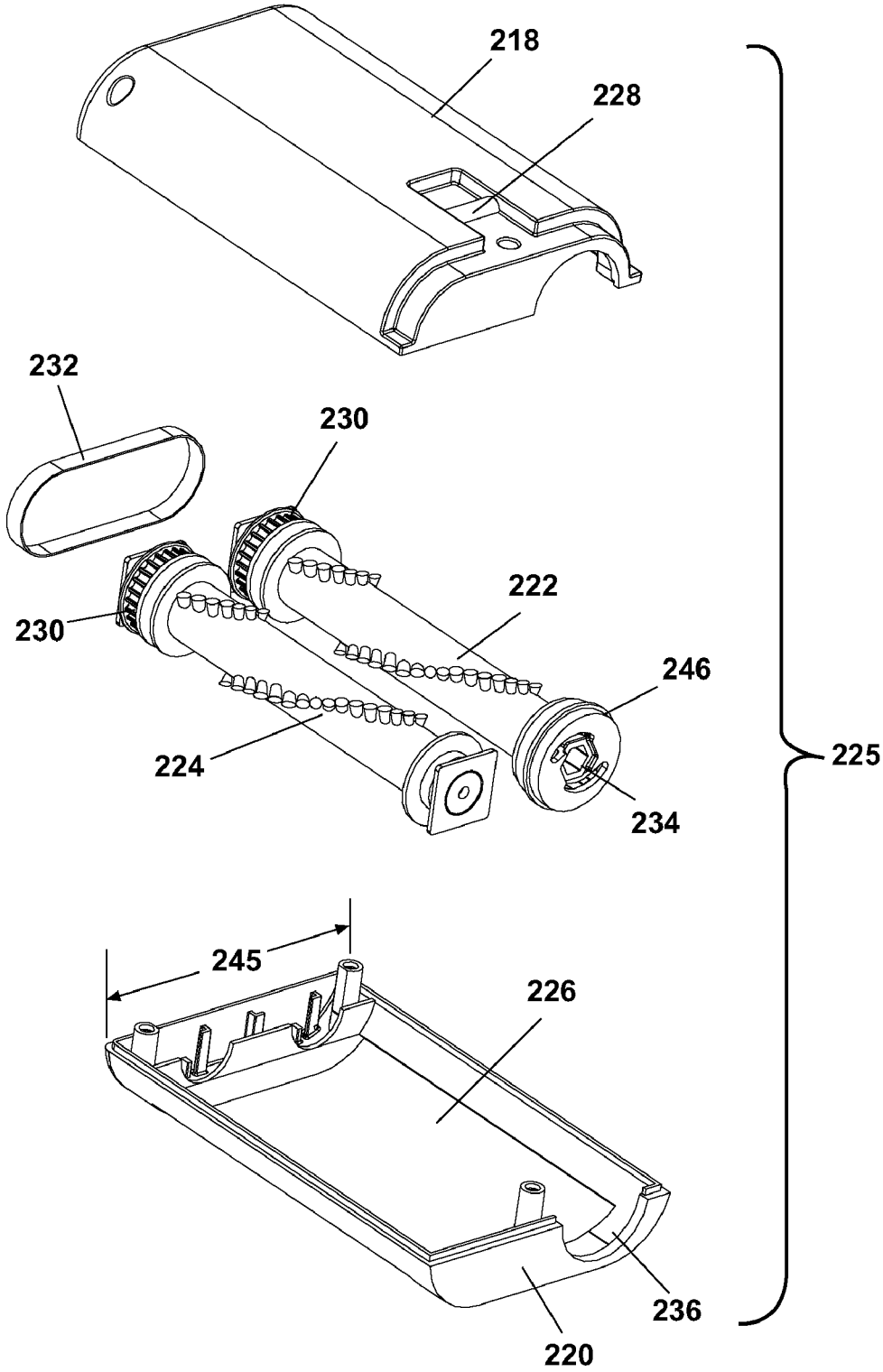
FIG. 15 is an exploded view of the agitator brush assembly according to the invention.
Figure 15A:
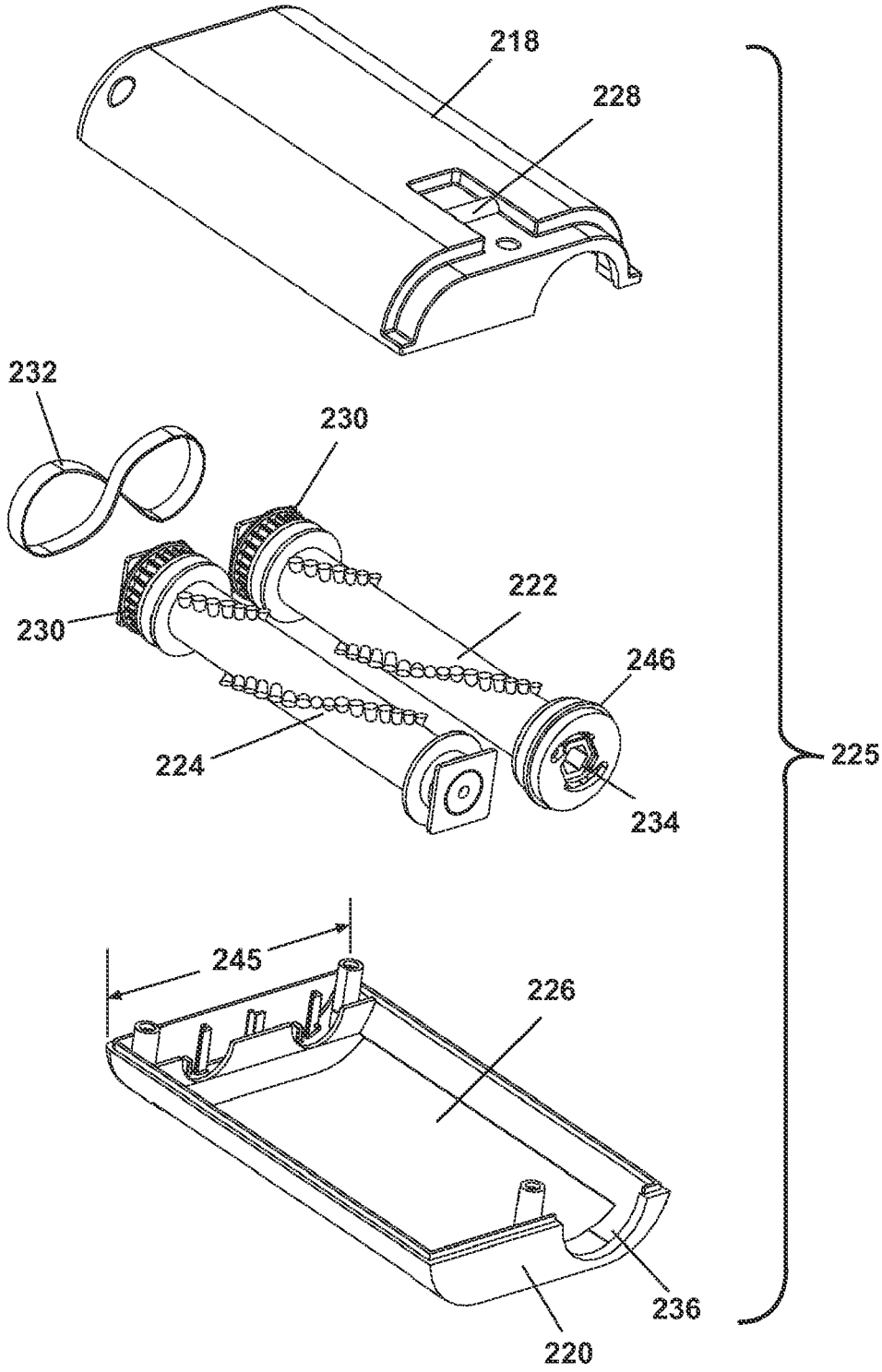
FIG. 15A is an exploded view of an alternate arrangement of the agitator brush assembly of FIG. 15 according to the invention.
Figure 16:
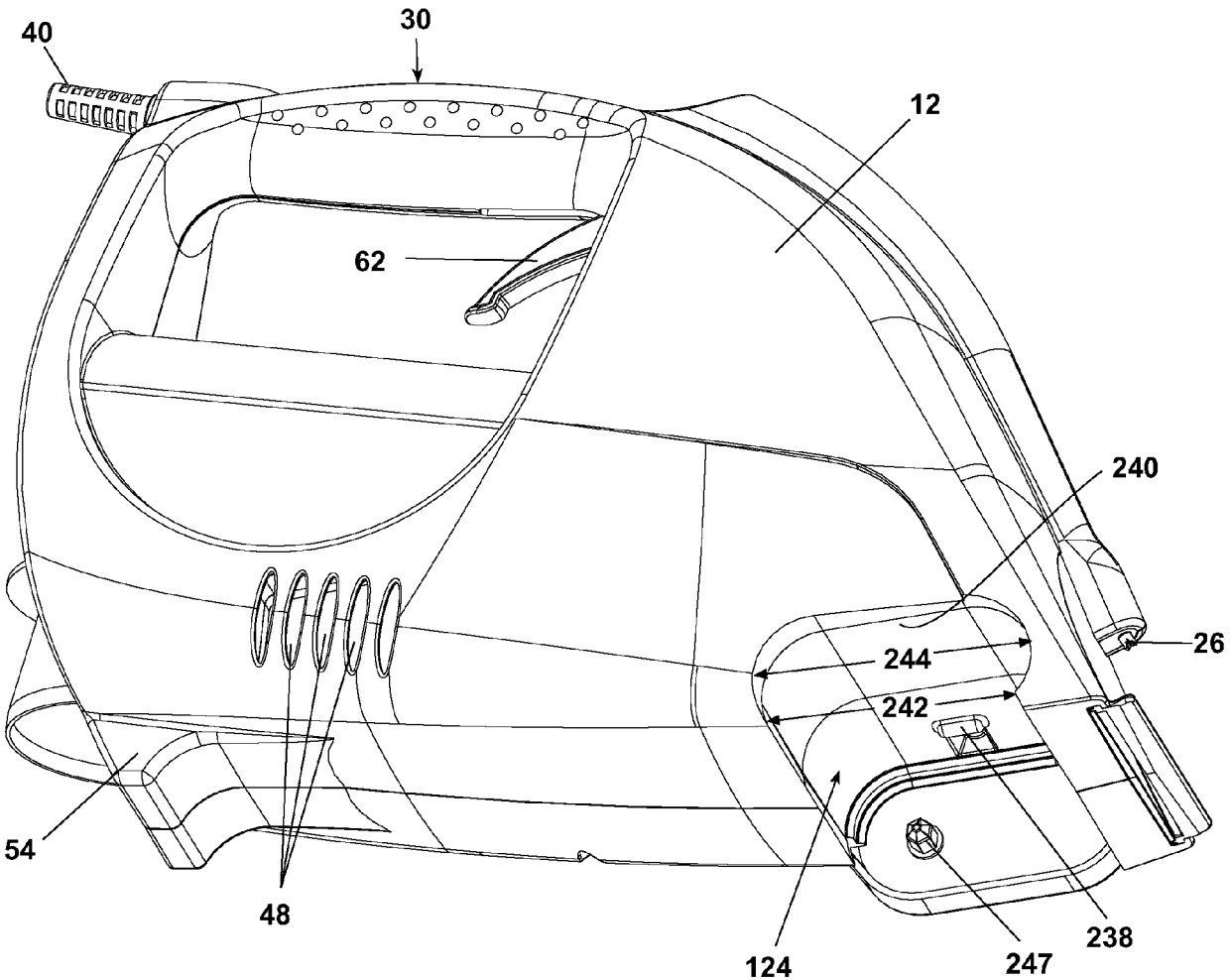
FIG. 16 is a perspective view of the underside of the housing of FIG. 2.

Looking now at FIGS. 15 and 16, the agitator brush assembly 14 comprises an upper shell 218 and a lower shell 220 that enclose first 222 and second 224 brush rolls in a cartridge 225. The lower shell has an opening 226 through which brushes on the brush rolls 222, 224 extend. In a preferred embodiment, the upper shell 218 is made of a transparent material. The upper shell 218 has a detent 228 near one end. The brush rolls 222, 224 are rotatably mounted within the cartridge 225, each brush roll having a pulley 230 at one end. A belt 232 extends around the pulleys 230 to drive the second brush roll 224 with the first brush roll 222. As shown in FIG. 15*a*, an alternate arrangement of the belt 232 provides for counter rotation of the brush rolls 222, 224 with respect to each other. The first brush roll 222 has a clutch disk 246 at the end opposite the pulley 230 with a drive socket 234 in it. The clutch disk 246 extends partially through an opening 236 in one end of the cartridge 225, or at a minimum, has the drive socket 234 exposed in the opening 236. The drive gear 168 (FIG. 9) is coupled through a drive shaft 248 to the first brush roll 222 with a hexagonal shape that is received in the drive socket 234.

In FIG. 16, the brush assembly receptacle 124 has a protrusion 238 extending downwardly from an upper surface 240. The receptacle is shaped so that the opening 242 thereto is slightly smaller than its widest dimension 244. The widest dimension 244 of the receptacle 124 is sized to roughly equate to the widest dimension 245 of the cartridge 225. Also, a keyed drive shaft 247 secured to the drive gear 168 (FIG. 9) extends through the end cap 167 into the receptacle 124. The agitator brush assembly 14 is thus removably receivable in the brush assembly receptacle 124 by snap fit, where the detent 228 on the cartridge 225 receives the protrusion 238, the drive socket 234 receives the keyed drive shaft 247, and the widest dimension 245 on the housing nests with the widest dimension 244 of the receptacle 124 to retain the agitator brush assembly 14 within the receptacle 124. Looking now also at FIG. 9, when the motor 130 is actuated, the brush drive shaft 134 rotates the first gear 164, which then rotates the reduction gear 166 and by way of the belt 170, also the drive gear 168 on the end cap 167. Rotation of the drive gear 168 causes rotation of the keyed drive shaft 247, which in turn rotates the first brush roll 222. As the first brush roll 22 rotates, the belt 232 urges the second brush roll 224 to also rotate.

Figure 17:
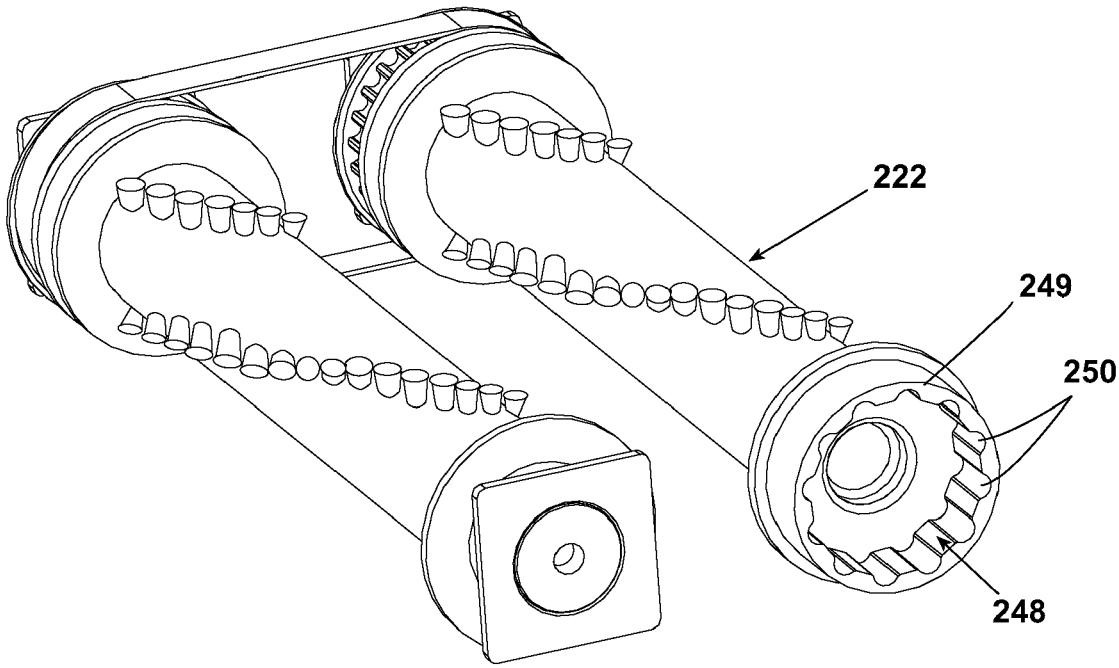
FIG. 17 is a perspective view of the brush rollers in the agitator brush assembly of FIG. 15.
Figure 18:
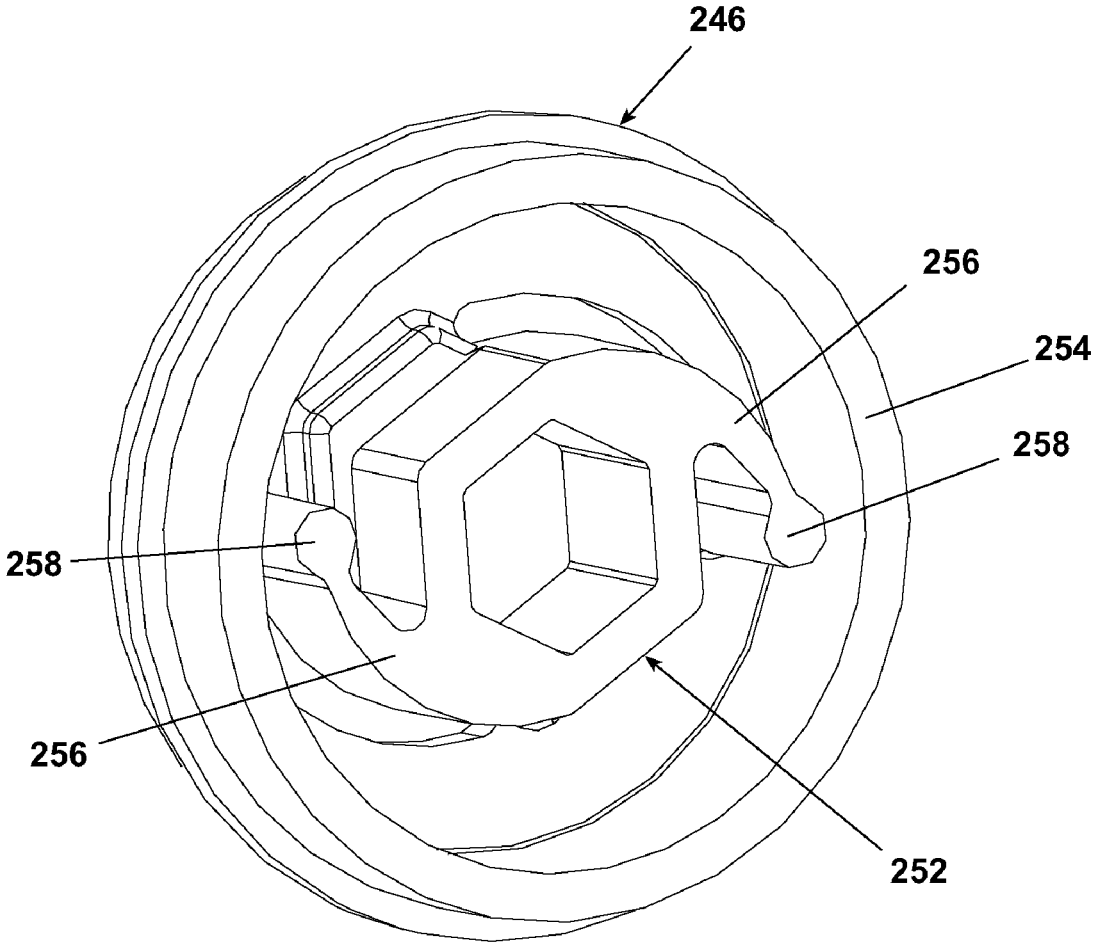
FIG. 18 is a perspective view of the clutch disk of the agitator brush assembly of FIG. 15.

Looking now at FIGS. 17 and 18, detail of the clutch disk 246 and its engagement with the brush roll 222 is shown. The brush roll 222 has at the end opposite the pulley 230 an interior drive surface 248 on an annular wall 249 populated by a series of axial depressions 250. (See FIG. 17). The clutch disk 246, on the other hand, has a hub 252 surrounded by and spaced from an annular wall 254. The interior diameter of the annular wall 254 is sized greater than the exterior diameter of the annular wall 249 so that it will fit over the annular wall 249 with the hub 252 received within the annular wall 254 and spaced from the interior drive surface 248, free to rotate relative thereto. A pair of arms 256 extends arcuately from the hub 252, and each has a nub 258 at the end, roughly having a diameter complementary in size and shape to a single axial depression 250. The arms 256 extend far enough that the nubs 258 nest within axial depressions 250 disposed 180° from each other. The arms 256 are resilient in that the ends thereof can deflect relative to the hub 252. The hub 252 on the side of the clutch disk 246 opposite the annular wall 254 has the drive socket 234. As the drive socket 234 is turned by the keyed drive shaft 247, the entire clutch disk 246 is rotated, including the hub 252 and the arms 256. Since the nubs 258 engage the axial depressions 250 in the interior drive surface 248, the annular wall 249 and thus also the brush roll 222 rotates with the keyed drive shaft 247. If rotation of the brush roll 222 is obstructed so that the force acting against rotation of the brush roll 22 is greater than the rotational force imparted by the keyed drive shaft 247, the nubs 258 are urged to slip out of the axial depressions 250, causing the clutch disk 246 to slip relative to the brush roll 222. In this way, the gear mechanism and the motor is protected against damage that may otherwise be caused by obstructions to rotation of the brush rolls 222, 224.

Figure 19:
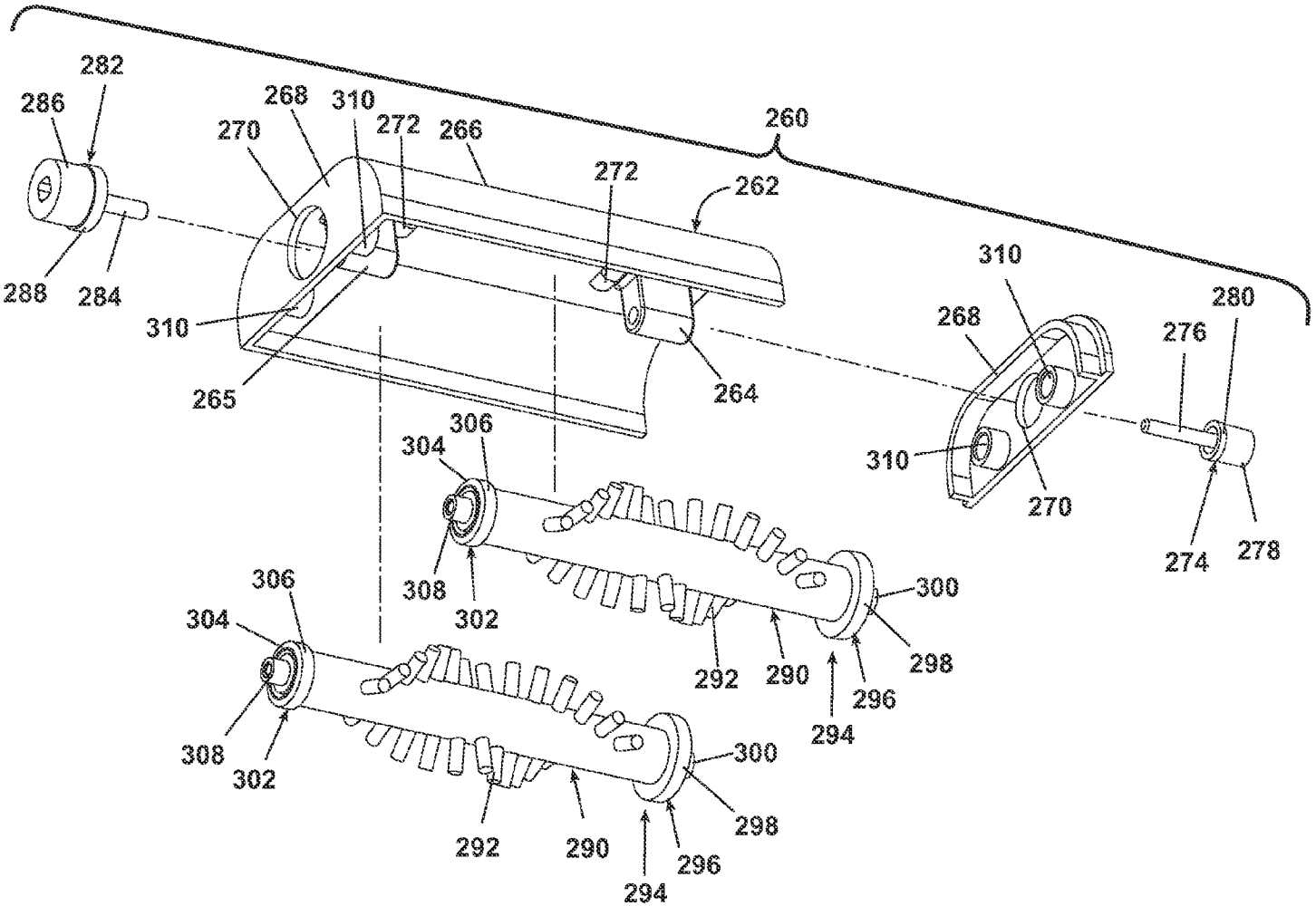
FIG. 19 is an exploded view of an alternate embodiment of the agitator brush assembly according to the invention.
Figure 20:
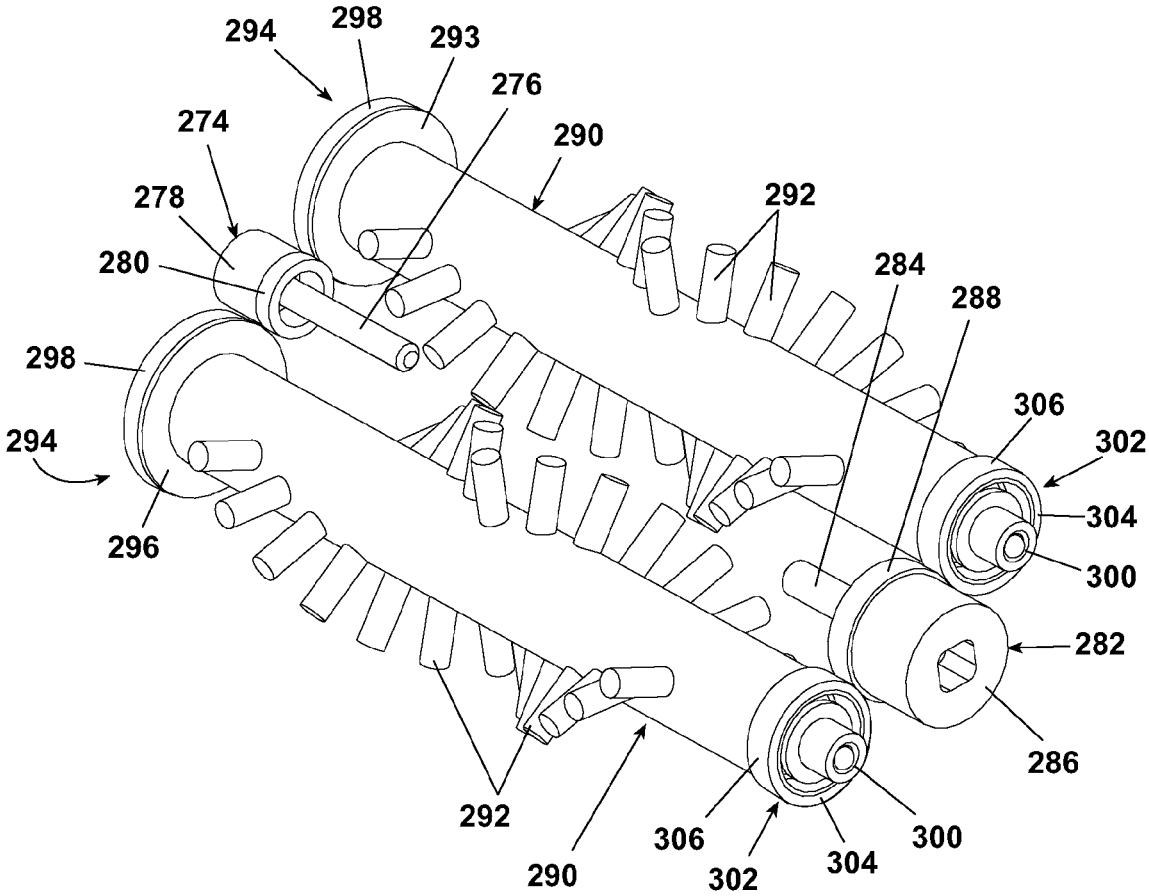
FIG. 20 is a perspective view of the brush rolls and drive wheels of the alternate embodiment of FIG. 19, seen from the opposite direction.

An alternate embodiment of the agitator brush assembly 260 is shown in FIGS. 19 and 20. The brush assembly 260 comprises an upper shell 262 having two identical axle sockets 264, 265 disposed at both ends of an upper wall 266. Preferably, the upper shell 262 is molded plastic and the axle sockets 264, 265 are formed in the molding process. End caps 268 cover each end of the upper shell 262. The end caps may be separate pieces assembled to the upper shell 262, or, as shown, one may be integral with the upper shell. Each end cap 268 has an opening 270 that is in registry with the adjacent axle socket 264 or 265 when the end cap is positioned on the upper shell 262. Also on the upper wall 266 on the outside of the upper shell 262 are two detents 272, one near each end.

A smaller drive wheel 274 has an axle pin 276 extending axially from one side and a keyed drive socket 278 extending axially from the other side. A high friction drive surface 280 surrounds the wheel intermediate the axle pin 276 and the keyed drive socket 278. The high friction drive surface 280 can be an added elastomer such as rubber or any other type of surface adapted to provide a high coefficient of friction. Alternatively, gears may be used in place of a high friction surface to transfer motion. The axle pin 276 is received in the axle socket 264 for free rotation therein, and the keyed drive socket 278 is in registry with the opening 270 of the adjacent end cap 268. A larger drive wheel 282 is similar in structure to the smaller drive wheel 274, having an axle pin 284 extending axially from one side and a keyed drive socket 286 extending axially from the other side. A high friction drive surface 288 surrounds the wheel intermediate the axle pin 284 and the keyed drive socket 286. The axle pin 284 is received in the axle socket 265 for free rotation therein. The larger drive wheel 282 has a larger diameter at the high friction surface 288 than the corresponding diameter of the smaller drive wheel 274.

The agitator brush assembly 14 has two identical brush rolls 290. For convenience, only one is described. The brush roll 290 has a series of bristles 292 helically disposed about its outer surface. The pattern, shape and type of bristles is conventional. As well, other types of conventional appendages are equally usable, such as paddles, flails, wires, etc.

One end 294 of the brush roll 290 has a larger diameter flange wheel 296. The peripheral edge of the larger diameter flange wheel 296 has a high friction surface 298. An axle pin 300 centered on the longitudinal axis of the brush roll 290 projects from the end 294. The other end 302 of the brush roll 290 has a smaller diameter flange wheel 304 with a high friction drive surface 306 on its peripheral edge. An axle pin 308 centered on the longitudinal axis of the brush roll 290 projects from the other end 302. The brush rolls 290 are mounted so that the axle pins 300, 308 rotate in sockets 310 that project inwardly from the end caps 268 on either side of the opening 270.

When assembled, the brush rolls 290 are thus disposed so that the larger diameter flange wheels 296 are adjacent to the smaller drive wheel 274 with their respective high friction surfaces 280, 298 touching each other (see FIG. 20). Similarly, the smaller diameter flange wheels 304 are adjacent to the larger drive wheel 282 with their respective high friction surfaces 288, 306 touching each other.

Figure 21:
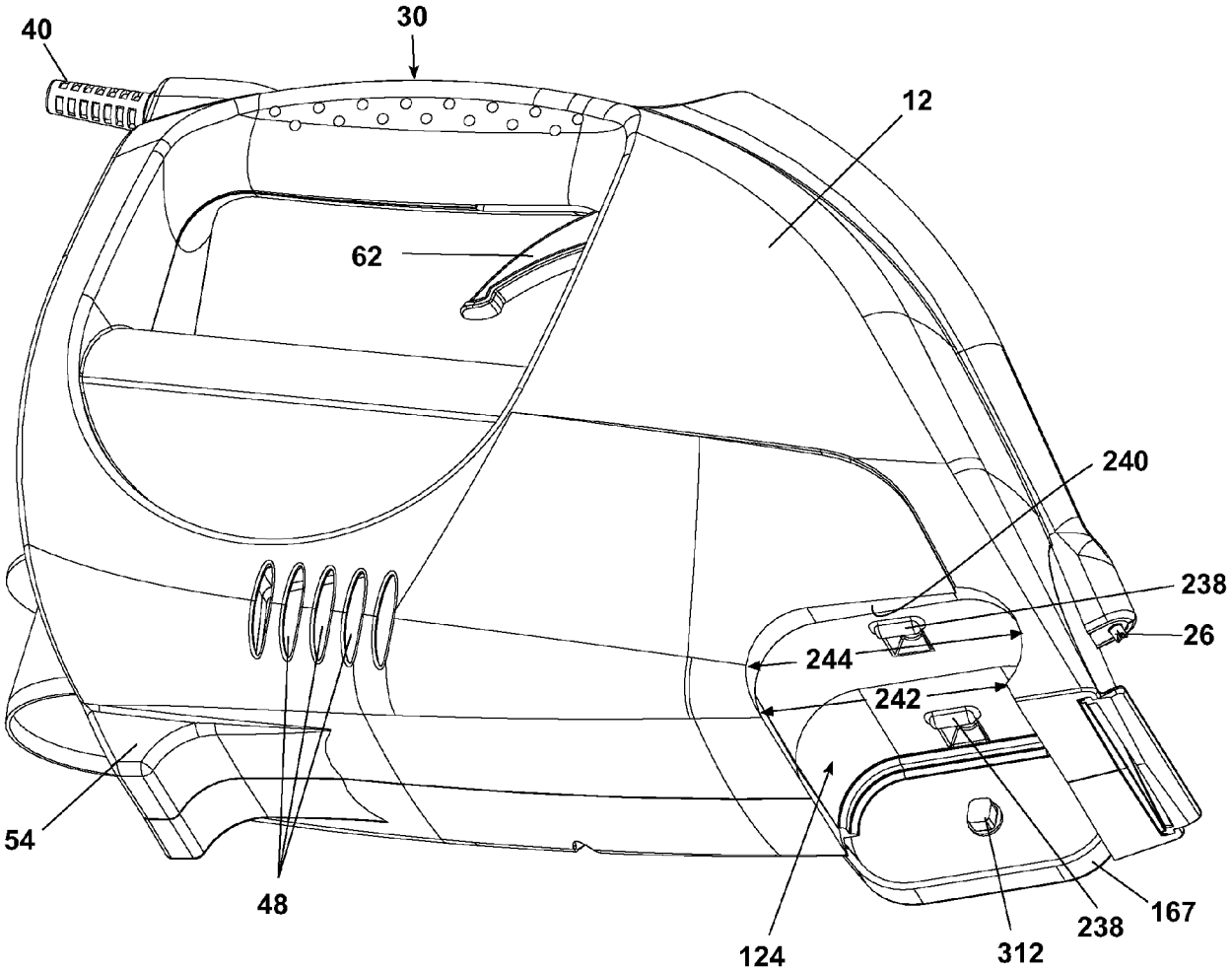
FIG. 21 is a perspective view of the underside of the housing of FIG. 2, adapted for the alternative embodiment of the agitator brush roll assembly of FIGS. 19 and 20.

Looking now at FIG. 21, it will be apparent that the brush assembly receptacle 124 is similar to that illustrated in FIG. 16, except that there are two protrusions 238 extending from the upper wall 240 and a drive shaft 312, keyed to the drive sockets 278, 286, is disposed in the center of the end cap 167. Consequently, the agitator brush assembly 260 can be selectively snapped into the receptacle 124 in either of two orientations, both which have the detents 272 snapped over the protrusions 238. In one direction, the keyed drive socket 278 on the smaller drive wheel 274 receives the keyed drive shaft 312. As the drive shaft rotates 248, so also does the smaller drive wheel 274. The frictional engagement of the high friction drive surfaces 280, 298 causes the brush rolls to simultaneously rotate at a given speed (perhaps slower than the rotation of the smaller drive wheel 274 if the larger diameter flange wheels 296 on that end of the brush rolls are larger than the smaller drive wheel 274). In the opposite orientation, the keyed drive socket 286 on the larger drive wheel 282 receives the keyed drive shaft 312. As the drive shaft rotates 248, so also does the larger drive wheel 282. The frictional engagement of the high friction drive surfaces 288, 306 causes the brush rolls to simultaneously rotate at a different speed than in the first orientation (perhaps faster than the rotation of the larger drive wheel 282 if the smaller diameter flange wheels 304 on that end of the brush rolls are smaller than the larger drive wheel 282). In any event, the structure enables a two speed operation of the brush rolls 290, depending solely upon which way the agitator brush roll assembly 14 is mounted in the receptacle 124.

For operation, cleaning fluid is introduced into the cleaning fluid supply tank 16, and the cleaner 10 is assembled as described above. The desired speed of the brush assembly is determined and the brush assembly placed into the receptacle as appropriate. In use, cleaning fluid is selectively delivered to the surface to be cleaned when the trigger 62 is squeezed. The solution and dirt on the surface are agitated by action of the brush assembly. Dirty fluid is then drawn from the surface through the air manifold 122 to the recovery tank 18, where air is separated from liquid and debris, depositing the latter in the recovery tank and exiting the recovery tank through the impeller 142 and then through the exhaust apertures 48.

Reasonable variation and modification are possible within the spirit of the foregoing specification and drawings without departing from the scope of the invention which is defined in the appended claims.

The invention claimed is:

1. In a liquid extraction cleaner comprising:

a housing having front and rear portions;

a dirty fluid extraction system mounted to the housing including:

a suction nozzle;

an air-liquid separator for separating air from liquid and debris;

a recovery tank in fluid communication with the suction nozzle for collecting recovered liquid and debris; and a vacuum source in fluid communication with the suction nozzle and the recovery tank for drawing liquid and debris through the suction nozzle and for depositing them into the recovery tank;

a cleaning fluid dispensing system mounted to the housing including:

a cleaning fluid supply tank;

a fluid distributor connected to the cleaning fluid supply tank for distributing cleaning fluid onto the surface to be cleaned; and a pocket formed in the rear portion thereof, wherein the recovery tank is removably received at least partially within the pocket;

the improvement comprising:

the housing has an integral handle between the front and rear portions thereof for carrying and operating the cleaner.

2. The liquid extraction cleaner according to claim 1 wherein the cleaning fluid supply tank and the recovery tank have interengaging releasable fasteners to removably mount the cleaning fluid supply tank to the recovery tank.

3. The liquid extraction cleaner according to claim 1 wherein the recovery tank further comprises an inlet duct and an outlet duct.

4. The liquid extraction cleaner according to claim 1 wherein the recovery tank further comprises a sealable opening that is closed with a cap to seal the opening, the cap having an outward-protrusion to facilitate removal of the cap from the opening and the cap protrusion matingly aligns with a recess in the housing when the recovery tank is properly seated within the pocket.

5. The liquid extraction cleaner according to claim 1 wherein the recovery tank further comprises at least one flange and the cleaning solution supply tank has a channel that slidably receives the flange for removably mounting the cleaning solution supply tank to the recovery tank.

6. The liquid extraction cleaner according to claim 5 wherein the at least one flange is on a top portion of the recovery tank and the cleaning solution supply tank channel is on a lower portion of the cleaning solution supply tank for removably mounting the cleaning solution tank to the recovery tank.

7. The liquid extraction cleaner according to claim 1 wherein the cleaning solution supply tank and the housing have interengaging releasable fasteners that removably mount the cleaning solution supply tank to the housing.

8. The liquid extraction cleaner according to claim 1 wherein the vacuum source further comprises a fan chamber defined in part by the housing.

9. The liquid extraction cleaner according to claim 8 wherein the vacuum source comprises an impeller to create working air flow and a motor for driving the impeller; the impeller has an inlet opening between the motor and the impeller, and working air from the vacuum source is delivered to the impeller inlet between the motor and the impeller.

10. In a liquid extraction cleaner comprising:
a housing having front and rear portions;
a dirty fluid extraction system mounted to the housing including:
a suction nozzle;
an air-liquid separator for separating air from liquid and debris;
a recovery tank in fluid communication with the suction nozzle for collecting recovered liquid and debris; and
a vacuum source in fluid communication with the suction nozzle and the recovery tank for drawing liquid and debris through the suction nozzle and for depositing them into the recovery tank;
a cleaning fluid dispensing system mounted to the housing including:
a cleaning fluid supply tank; and
a fluid distributor connected to the cleaning fluid supply tank for distributing cleaning fluid onto the surface to be cleaned; and
the housing has a rearwardly extending pocket at the rear portion thereof, wherein the recovery tank is removably received at least partially within the pocket;
the improvement comprising:
a cartridge that is removably mounted to the front portion of the housing, the removable cartridge further comprises at least one rotatable agitation brush that is driven by a drive motor and wherein the rotation direction of the at least one brush is determined by the orientation of the cartridge in the housing.

11. The liquid extraction cleaner according to claim 10 and wherein the cartridge comprises at least two rotatable agitation brushes.

12. The liquid extraction cleaner according to claim 11 wherein the at least two-rotatable agitation brushes are configured to rotate in the same direction.

13. The liquid extraction cleaner according to claim 11 wherein the at least two rotatable agitation brushes are configured to rotate in different directions.

14. The liquid extraction cleaner according to claim 10 wherein the orientation of the cartridge to the housing determines the rotational speed of the at least one brush.

15. The liquid extraction cleaner according to claim 10 and further comprising a clutch mechanism between the brush and the drive motor to disconnect the drive motor from the brush when the brush resistance exceeds a predetermined torque.

16. The liquid extraction cleaner according to claim 15 wherein the clutch mechanism comprises a plurality of resilient fingers connected to one of the drive motor and the brush and that extend generally radially and a ring mounted to the other of the drive motor and the brush and with a plurality of indentations that receive the resilient fingers.

17. In a liquid extraction cleaner comprising:
a housing having front and rear portions;
a dirty fluid extraction system including:
a suction nozzle;
an air-liquid separator for separating air from liquid and debris;
a recovery tank in fluid communication with the suction nozzle for collecting recovered liquid and debris; and
a vacuum source in fluid communication with the suction nozzle and the recovery tank for drawing liquid and debris through the suction nozzle and for depositing them into the recovery tank; and
a cleaning fluid dispensing system including:
a cleaning fluid supply tank; and
a fluid distributor connected to the cleaning fluid supply tank for distributing cleaning fluid onto the surface to be cleaned;
wherein the recovery tank further comprises at least one flange and the cleaning solution supply tank has a channel that slidably receives the flange to removably mount the cleaning solution supply tank to the recovery tank.

18. The liquid extraction cleaner according to claim 17 wherein the at least one flange is on a top portion of the recovery tank and the cleaning solution supply tank channel is on a lower portion of the cleaning solution supply tank to removably mount the cleaning solution supply tank to the recovery tank.

19. The liquid extraction cleaner according to claim 17 wherein the cleaning solution supply tank and the housing have interengaging releasable fasteners that removably mount the cleaning solution supply tank to the housing.

20. The liquid extraction cleaner according to claim 17 wherein the recovery tank can be removed from the housing with or without the cleaning solution supply tank attached thereto.

21. The liquid extraction cleaner according to claim 17 wherein the cleaning solution supply tank can be removed from the recovery tank with the recovery tank mounted to the housing.

22. In a liquid extraction cleaner comprising:
a housing having front and rear portions;
a dirty fluid extraction system including:
a suction nozzle;
an air-liquid separator for separating air from liquid and debris;
a recovery tank in fluid communication with the suction nozzle for collecting recovered liquid and debris; and
a vacuum source for drawing liquid and debris through the suction nozzle and for depositing them into the recovery tank;
a cleaning fluid dispensing system including:
a cleaning fluid supply tank; and
a fluid distributor connected to the cleaning fluid supply tank for distributing cleaning fluid onto the surface to be cleaned;
the improvement comprising:
the vacuum source comprises an impeller to create a working air flow and a motor for driving the impeller; the impeller has an inlet opening between the motor and the impeller, and wherein working air from the vacuum source is delivered to the impeller from the inlet opening between the motor and the impeller.

23. The liquid extraction cleaner according to claim 22 wherein the impeller has an outlet opening that is positioned distal to the motor.

24. The liquid extraction cleaner according to claim 23 and further comprising a fan chamber that is formed in part by the housing.

25. The liquid extraction cleaner according to claim 24 and further comprising an exhaust conduit having a vent opening formed in part by the housing.

* * * * *